US011545095B2

(12) United States Patent
Yun et al.

(10) Patent No.: US 11,545,095 B2
(45) Date of Patent: Jan. 3, 2023

(54) DISPLAY DEVICE

(71) Applicant: LG Display Co., Ltd., Seoul (KR)

(72) Inventors: Junwoo Yun, Goyang-si (KR); Taegung Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 121 days.

(21) Appl. No.: 17/112,888

(22) Filed: Dec. 4, 2020

(65) Prior Publication Data

US 2021/0201825 A1 Jul. 1, 2021

(30) Foreign Application Priority Data

Dec. 30, 2019 (KR) ..... 10-2019-0178201

(51) Int. Cl.
*G09G 3/3291* (2016.01)
*G09G 3/20* (2006.01)
*G09G 3/3233* (2016.01)

(52) U.S. Cl.
CPC ..... *G09G 3/3291* (2013.01); *G09G 3/2003* (2013.01); *G09G 3/3233* (2013.01); *G09G 2300/0413* (2013.01); *G09G 2300/0452* (2013.01); *G09G 2320/0285* (2013.01); *G09G 2320/043* (2013.01); *G09G 2330/12* (2013.01); *G09G 2360/16* (2013.01)

(58) Field of Classification Search
USPC ..... 345/76
See application file for complete search history.

(56) References Cited

U.S. PATENT DOCUMENTS

2017/0345377 A1* 11/2017 Oh ..... G09G 3/3208
2018/0151119 A1* 5/2018 Lee ..... G09G 3/3291
2019/0035331 A1 1/2019 Do et al.

FOREIGN PATENT DOCUMENTS

EP 3252750 A1 12/2017
KR 10-2016-0032759 A 3/2016

* cited by examiner

*Primary Examiner* — Ifedayo B Iluyomade
(74) *Attorney, Agent, or Firm* — Seed IP Law Group LLP

(57) ABSTRACT

One or more embodiments of the present disclosure provides a display device. The display device includes a display panel which includes a plurality of pixels; a threshold voltage sensing circuit which senses a threshold voltage of a light emitting diode included in the plurality of pixels, a data compensating circuit which corrects a data signal in accordance with a variation of the threshold voltage and accumulated data to generate a corrected data signal, and a data driver which generates a data voltage in accordance with the corrected data signal to output the data voltage to the display panel, in which the data compensating circuit periodically corrects the data signal in accordance with a look-up table in which a relationship of the variation of the threshold voltage and the accumulated data is described during an aging period to generate the corrected data signal. The display device according to the present disclosure improves an image quality of the display.

16 Claims, 17 Drawing Sheets

DISPLAY DEVICE

CROSS-REFERENCE TO RELATED APPLICATIONS

This application claims the priority of Korean Patent Application No. 10-2019-0178201 filed on Dec. 30, 2019, in the Korean Intellectual Property Office, the disclosure of which is incorporated herein by reference.

BACKGROUND

Technical Field

The present disclosure relates to a display device and a driving method of the same, and more particularly, to a display device which corrects a data signal in real time and a driving method of the same.

Description of the Related Art

As the information society develops, the demand for display devices which display images is increasing in various forms. Therefore, recently, various flat panel display devices (FPD) which are capable of reducing a weight and a volume which are disadvantages of cathode ray tubes have been developed and marketed. For example, various display devices such as a liquid crystal display device LCD, a plasma display panel PDP, or an organic light emitting diode OLED display device are utilized.

A display panel of the display device includes a plurality of pixels which is defined by gate lines and data lines. Each of the plurality of pixels includes at least one light emitting diode and at least one light emitting diode implements gray scale corresponding to a data voltage in accordance with the gate voltage.

BRIEF SUMMARY

The inventors of the present disclosure have recognized that the light emitting diode is degraded due to continuous driving so that the degraded light emitting diode cannot implement the gray scale corresponding to the data voltage. Therefore, by recognizing the problem of an image quality of the display device being lowered due to the degradation of the light emitting diode, the inventors of the present disclosure provided a display device which suppresses the lowering of the image quality due to the degradation of the light emitting diode and a driving method of the same.

Further embodiments of the present disclosure provides a display device which senses a degradation degree of the light emitting diode in real time to suppress the damage of the image quality due to the driving for a long time and a driving method of the same.

Technical benefits of the present disclosure are not limited to the above-mentioned benefits, and other benefits, which are not mentioned above, can be clearly understood by those skilled in the art from the following descriptions.

In order to achieve the above-described benefits, according to an aspect of the present disclosure, a display device includes a display panel which includes a plurality of pixels; a threshold voltage sensing unit which senses a threshold voltage of a light emitting diode included in the plurality of pixels; a data compensating unit which corrects a data signal in accordance with a variation of the threshold voltage and accumulated data to generate a corrected data signal; and a data driver which generates a data voltage in accordance with the corrected data signal to output the data voltage to the display panel, in which the data compensating unit periodically corrects the data signal in accordance with a look-up table in which a relationship of the variation of the threshold voltage and the accumulated data is described during an aging period to generate the corrected data signal, thereby improving an image quality.

Other detailed matters of the embodiments are included in the detailed description and the drawings.

According to the present disclosure, a gain is periodically corrected during a driving period so as to match a standard gain so that an afterimage due to over-compensation or less-compensation of a data signal does not remain in one area of the display panel.

According to the present disclosure, it is periodically determined whether the compensation of the data signal is appropriate by a test pattern disposed in a dummy area to suppress erroneous compensation even during a long-time driving, thereby improving an image quality.

The effects according to the present disclosure are not limited to the contents exemplified above, and more various effects are included in the present specification.

BRIEF DESCRIPTION OF THE SEVERAL VIEWS OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
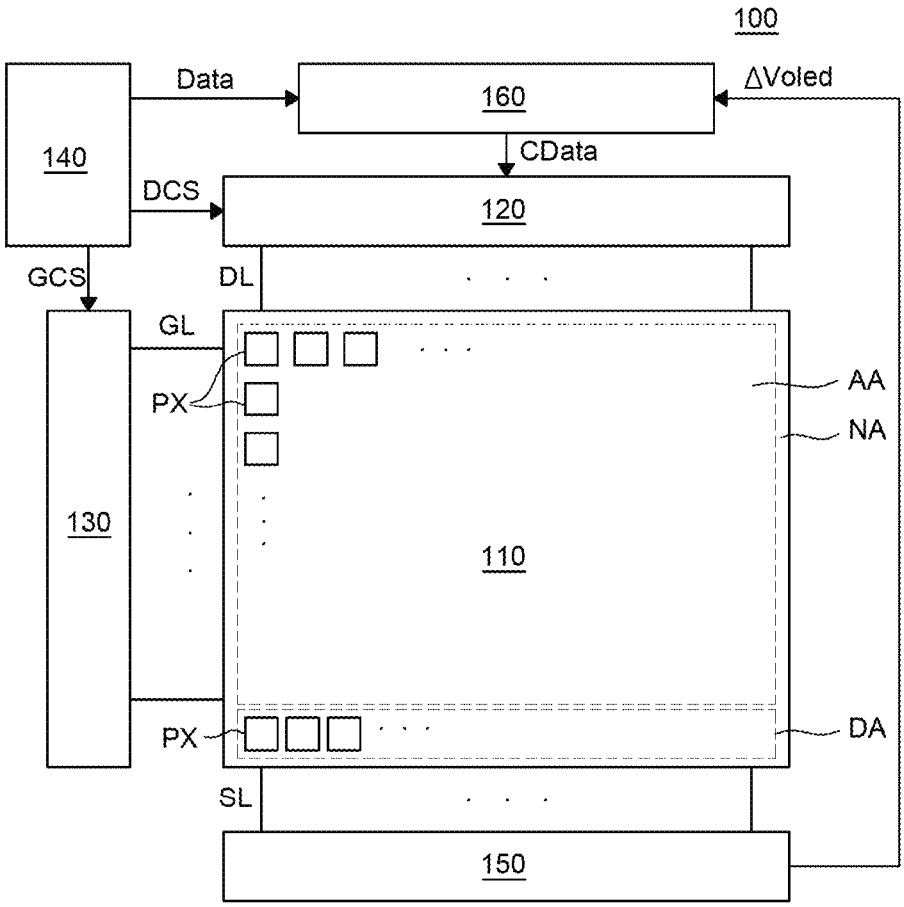
FIG. 1 is a schematic block diagram for explaining a display device according to an embodiment of the present disclosure.

Advantages and characteristics of the present disclosure and a method of achieving the advantages and characteristics will be clear by referring to embodiments described below in detail together with the accompanying drawings. However, the present disclosure is not limited to the embodiments disclosed herein but will be implemented in various forms. The embodiments are provided by way of example only so that those skilled in the art can fully understand the disclosures of the present disclosure and the scope of the present disclosure.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the specification. Further, in the following description of the present disclosure, a detailed explanation of known related technologies may be omitted to avoid unnecessarily obscuring the subject matter of the present disclosure. The terms such as "including," "having" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly".

When an element or layer is disposed "on" another element or layer, another layer or another element may be interposed directly on the other element or therebetween.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Like reference numerals generally denote like elements throughout the specification.

A size and a thickness of each component illustrated in the drawing are illustrated for convenience of description, and the present disclosure is not limited to the size and the thickness of the component illustrated.

The features of various embodiments of the present disclosure can be partially or entirely adhered to or combined with each other and can be interlocked and operated in technically various ways, and the embodiments can be carried out independently of or in association with each other.

Hereinafter, a display device according to embodiments of the present disclosure will be described in detail with reference to accompanying drawings.

FIG. 1 is a schematic block diagram for explaining a display device according to an embodiment of the present disclosure.

Figure 2:
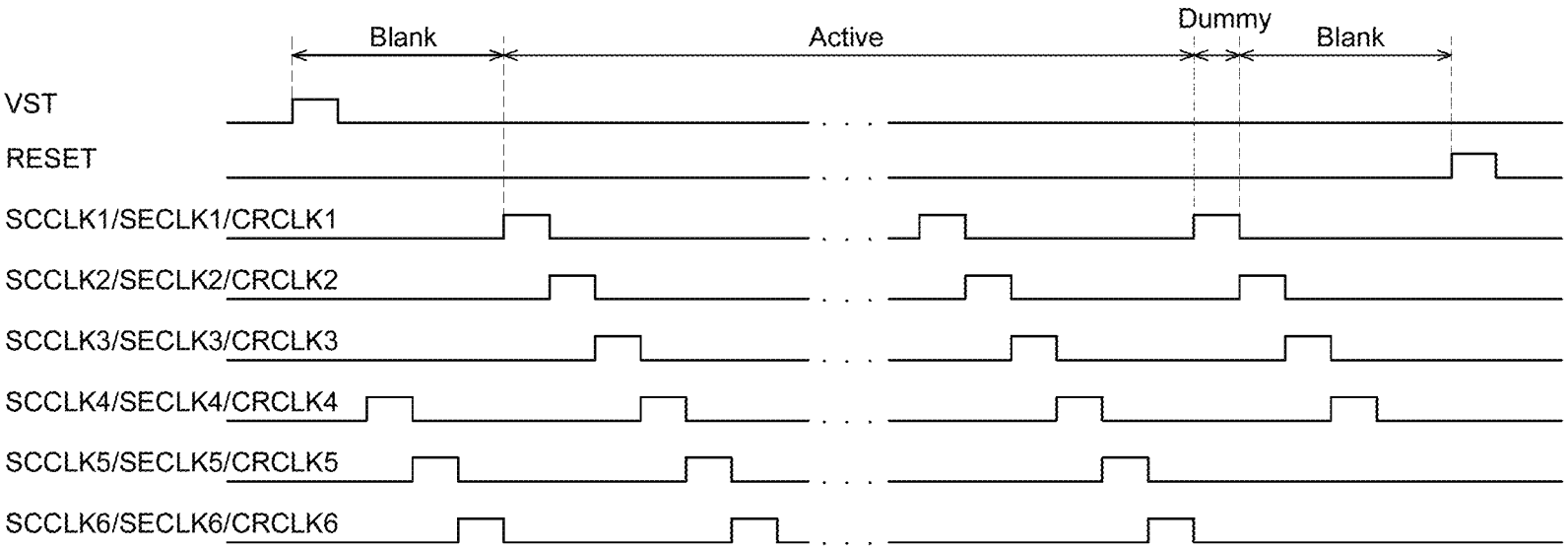
FIG. 2 is a timing chart for explaining an operation of a display device according to an embodiment of the present disclosure during a driving period.

FIG. 2 is a timing chart for explaining an operation of a display device according to an embodiment of the present disclosure during a driving period.

Referring to FIG. 1, a display device 100 according to an embodiment of the present disclosure includes a display panel 110, a data driver 120, a gate driver 130, a timing controller 140, a threshold voltage sensing unit 150, and a data compensating unit 160. The term "unit" as used herein includes any electrical circuitry, features, components, an assembly of electronic components or the like configured to perform the various operations as described herein. In some embodiments, the various units may be included in or otherwise implemented by processing circuitry such as a microprocessor, microcontroller, integrated circuit, chip, microchip or the like. Further, in one or more embodiments, the threshold voltage sensing unit 150 and the threshold voltage sensing circuit 150 may be interchangeably used. Similarly, the compensating unit 160 and the compensating circuit 160 may be interchangeably used.

The display panel 110 includes a plurality of gate lines GL and a plurality of data lines DL disposed on a substrate using glass or plastic to overlap with each other in a matrix-like shape. A plurality of pixels PX is defined by the plurality of gate lines GL and the data lines DL.

The plurality of pixels PX of the display panel 110 is connected to the gate lines GL and the data lines DL, respectively. The plurality of pixels PX operates based on gate voltages transmitted from the gate lines GL and data voltages transmitted from the data lines DL.

Each of the plurality of pixels PX includes a red sub pixel which emits red light, a green sub pixel which emits green light, a blue sub pixel which emits blue light, and a white sub pixel which emits white light.

However, each of the plurality of pixels PX is not limited thereto and may include sub pixels having various colors.

Therefore, since each of the plurality of pixels PX includes a white sub pixel which emits white light, data voltages output to the red sub pixel, the green sub pixel, and the blue sub pixel are reduced so that an overall power consumption of the display device 100 may be reduced.

Further, when the display device 100 according to the embodiment of the present disclosure is an organic light emitting display device, current is applied to an organic light emitting diode included in the plurality of pixels PX and discharged electrons and holes are coupled to generate excitons. The excitons emit light to implement a gray scale of the organic light emitting display device.

With regard to this, the display device 100 according to the embodiment of the present disclosure is not limited to the organic light emitting display device, but may be various types of display device such as a liquid crystal display device.

In the meantime, the display panel 110 may be divided into an active area AA in which images in accordance with a data signal Data are implemented and a dummy area DA in which a specific test pattern for measuring a degradation degree is implemented.

As illustrated in FIG. 1, the dummy area DA may be disposed at one side portion of the active area AA, but the disposed location of the dummy area DA is not limited thereto.

That is, in the dummy area DA, a separate image is not implemented so that there is no need to expose the dummy area DA to a user. Therefore, the dummy area DA of the display panel 110 may be blocked by a finishing material which encloses the display panel 110.

Even though in FIG. 1, it is illustrated that the plurality of pixels PX disposed in the dummy area DA is disposed in one line, the plurality of pixels PX disposed in the dummy area DA may be disposed in various forms.

In the meantime, the display device 100 according to the embodiment of the present disclosure may be driven separately in an aging period and a driving period.

Specifically, the display device according to the embodiment of the present disclosure not only stabilizes the plurality of pixels PX but also generates a look-up table for gain correction to be described below, through the aging period. During the driving period after the aging period, the display panel periodically corrects a gain which is applied to the data signal Data by referring to the look-up table, thereby to consistently feedback the image quality.

To be more specific, as illustrated in FIG. 2, during the driving period, one frame includes an active section in which an image is implemented in accordance with a data signal, a dummy section in which a test pattern disposed in the dummy area DA is driven, and a blank section in which an image is not output to the display panel 110.

That is, in the dummy section, the test pattern disposed in the dummy area DA is driven to compare a characteristic measured by the test pattern with the look-up table to correct a gain which is applied to the data signal Data so that the image quality may be optimized in real time even during the driving period.

The timing controller 140 supplies a data control signal DCS to the data driver 120 to control the data driver 120 and supplies a gate control signal GCS to the gate driver 130 to control the gate driver 130.

That is, the timing controller 140 starts scanning in accordance with a timing implemented by each frame, based on the timing signal received from an external host system.

More specifically, the timing controller 140 receives various timing signals including a vertical synchronization signal Vsync, a horizontal synchronization signal Hsync, a data enable signal DE, and a data clock signal DCLK together with the image data Data, from the external host system.

In order to control the data driver 120 and the gate driver 130, the timing controller 140 receives the timing signal such as the vertical synchronization signal Vsync, the horizontal synchronization signal Hsync, the data enable signal DE, and the data clock signal DCLK and generates various control signals DCS and GCS. The timing controller 140 outputs the various control signals DCS and GCS to the data driver 120 and the gate driver 130.

For example, in order to control the gate driver 130, the timing controller 140 outputs various gate control signals GCS including a gate start pulse GSP, a gate shift clock GSC, a gate output enable signal GOE, and the like.

Here, the gate start pulse controls an operation start timing of one or more gate circuits which configure the gate driver 130. The gate shift clock is a clock signal which is commonly input to one or more gate circuits and controls a shift timing of the scan signal (gate pulse). The gate output enable signal designates timing information of one or more gate circuits.

Further, in order to control the data driver 120, the timing controller 140 outputs various data control signals DCS including a source start pulse SSP, a source sampling clock SSC, a source output enable signal SOE, and the like.

Here, the source start pulse controls a data sampling start timing of one or more data circuits which configure the data driver 120. The source sampling clock is a clock signal which controls a sampling timing of data in each data circuit. The source output enable signal controls an output timing of the data driver 120.

The timing controller 140 converts image data received from the external system according to a data signal Data format which is processible in the data compensating unit 160 and outputs the converted video signal. By doing this, the timing controller 140 controls data driving at an appropriate timing in accordance with the scanning.

The timing controller 140 may be disposed on a source printed circuit board to which the data driver 120 is bonded, and a control printed circuit board which is connected, through a connecting medium such as a flexible flat cable (FFC) or a flexible printed circuit (FPC).

The gate driver 130 sequentially supplies gate voltages to the gate lines GL in accordance with the control of the timing controller 140.

For example, as illustrated in FIG. 2, the gate driver 130 outputs a gate voltage which drives a dummy line of the gate driver 130 in the blank section, outputs a gate voltage to the gate line GL disposed in the active area AA in the active section, and outputs a gate voltage to the gate line GL disposed in the dummy area DA in the dummy section. By doing this, the test pattern disposed in the dummy area DA is driven.

According to a driving method, the gate driver 130 may be located only at one side of the display panel 110 or located at both sides, as necessary.

The gate driver 130 may be connected to a bonding pad of the display panel 110 by means of a tape automated bonding (TAB) method or a chip on glass (COG) method. The gate driver 130 may be implemented as a gate in panel (GIP) type to be directly disposed in the display panel 110 or may be integrated to be disposed in the display panel 110, as necessary.

The gate driver 130 may include a shift register and a level shifter.

The threshold voltage sensing unit 150 senses a threshold voltage of the light emitting diode disposed in each pixel PX.

That is, the threshold voltage sensing unit 150 is connected to the light emitting diode disposed in each pixel PX through a sensing line SL and senses a voltage which is applied to one electrode of the light emitting diode to sense a threshold voltage of the light emitting diode.

Further, the threshold voltage sensing unit 150 outputs a threshold voltage variation ΔVoled corresponding to a variation ΔVoled of a threshold voltage of the light emitting diode due to the degradation to the data compensating unit 160.

To this end, the threshold voltage sensing unit 150 may include a differential amplifier which extracts a value of a variation ΔVoled of the threshold voltage of the light emitting diode due to the degradation and an analog digital converter ADC which changes an analog voltage into a digital signal.

The data compensating unit 160 compensates for a data signal Data in accordance with the degradation degree of the light emitting diode to output a compensated data signal CData.

Specifically, the data compensating unit 160 determines a degradation degree of the light emitting diode in accordance with accumulated data which reflects an amount of accumulated data signal Data and the threshold voltage variation ΔVoled. Further, the gain is applied in accordance with the degradation degree of the light emitting diode to compensate for the data signal Data and output a compensated data signal CData to the data driver 120.

That is, the data compensating unit 160 counts the data signal Data to generate accumulated data and determines a gain of the data signal Data in accordance with the accumulated data and the threshold voltage variation ΔVoled, and then reflects the gain to the data signal Data to output the compensated data signal CData.

Further, for more precise compensation, the data compensating unit 160 generates a look-up table for accumulated data and the threshold voltage variation ΔVoled during the aging period, and then corrects the gain in real time based on the look-up table during the driving period to generate the corrected data signal CData.

The data driver 120 converts the compensated data signal CData received from the data compensating unit 160 into an analog data voltage Vdata and outputs the analog data voltage to the data lines DL.

The data driver 120 is connected to a bonding pad of the display panel 110 by a tape automated bonding method or a chip on glass method or may be directly disposed on the display panel 110. If necessary, the data driver 120 may be disposed to be integrated in the display panel 110.

Further, the data driver 120 may be implemented by a chip on film COF method. In this case, one end of the data driver 120 may be bonded to at least one source printed circuit board and the other end may be bonded to the display panel 110.

The data driver 120 may include a logic unit including various circuits such as a level shifter or a latch unit, a digital analog converter DAC, and an output buffer.

Further, the data driver may further include a power controller which is disposed on the control printed circuit board to supply various voltages or currents to the display panel 110, the data driver 120, the gate driver 130, the timing controller 140, the threshold voltage sensing unit 150, and the data compensating unit 160 or control various voltages or currents to be supplied. The power controller may be referred to as a power management integrated circuit PMIC.

Hereinafter, a circuit structure of a pixel PX of a display device according to an embodiment of the present disclosure will be described in detail with reference to FIG. 3.

Figure 3:
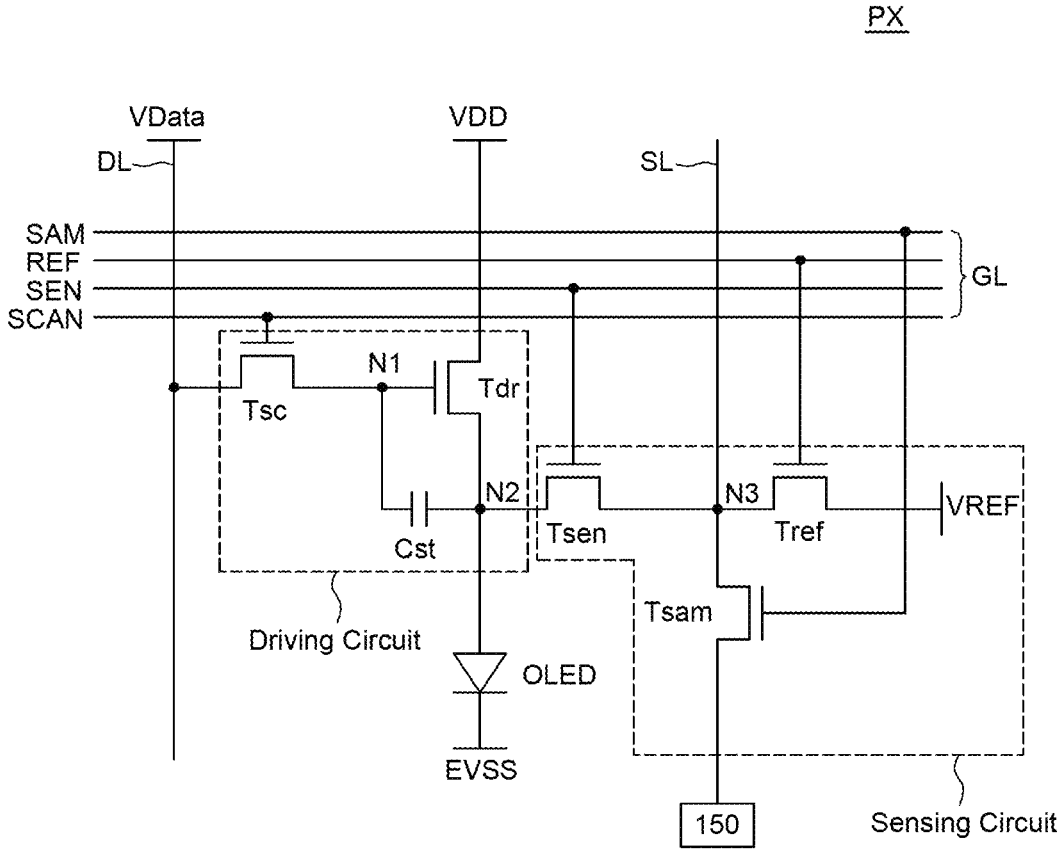
FIG. 3 is a circuit diagram of a pixel of a display device according to an embodiment of the present disclosure.

FIG. 3 is a circuit diagram of a pixel of a display device according to an embodiment of the present disclosure.

As illustrated in FIG. 2, each pixel PX includes an organic light emitting diode OLED which is a light emitting diode, a driving circuit which drives the organic light emitting diode OLED, and a sensing circuit which senses a threshold voltage Voled of the organic light emitting diode OLED.

The driving circuit includes a driving transistor Tdr, a scan transistor Tsc, and a storage capacitor Cst.

The scan transistor Tsc applies a data voltage Vdata to a first node N1 in accordance with a scan signal SCAN. In the scan transistor Tsc, the scan signal SCAN is applied to the gate electrode and the data voltage Vdata is applied to the first electrode and the second electrode is connected to the first node N1. The first node N1 may correspond to the gate electrode of the driving transistor Tdr. Therefore, when the scan signal SCAN is in a turn-on level, the scan transistor Tsc is turned on to apply the data voltage Vdata to the first node N1.

The driving transistor Tdr supplies the driving current to the organic light emitting diode OLED to drive the organic light emitting diode OLED. In the driving transistor Tdr, the gate electrode is connected to the first node N1, a high potential driving voltage VDD is applied to the first electrode and the second node N2 is connected to the second electrode. One electrode of the organic light emitting diode OLED is connected to the second node N2. Therefore, the driving current is determined in accordance with a gate-source voltage Vgs of the driving transistor Tdr to control the organic light emitting diode OLED.

The storage capacitor Cst is connected between the first node N1 which is the gate electrode of the driving transistor Tdr and the second node N2 which is a second electrode of the driving transistor Tdr to maintain the gate-source voltage Vgs of the driving transistor Tdr for one frame. By doing this, the organic light emitting diode OLED may maintain a constant luminance for one frame.

The sensing circuit includes a sensing transistor Tsen, an initializing transistor Tref, and a sampling transistor Tsam.

The sensing transistor Tsen electrically connects the second node N2 and the third node N3 in accordance with the sensing signal SEN. In the sensing transistor Tsen, the sensing signal SEN is applied to the gate electrode, the second node N2 is connected to the first electrode, and the second electrode is connected to the third node N3. One electrode of the organic light emitting diode OLED is connected to the second node N2 and the sensing line SL is connected to the third node N3. Accordingly, when the sensing signal SEN is in a turn-on level, the sensing transistor Tsen is turned on to connect one electrode of the organic light emitting diode OLED to the sensing line SL.

The initializing transistor Tref applies an initialization voltage VREF to the third node N3 in accordance with the initialization signal REF. In the initializing transistor Tref, the initialization signal REF is applied to the gate electrode and the initialization voltage VREF is applied to the first electrode and the second electrode is connected to the third node N3. Therefore, when the initialization signal REF is in a turn-on level, the initializing transistor Tref is turned on to apply the initialization voltage VREF to the third node N3 which is the sensing line SL.

The sampling transistor Tsam may sample a voltage which is applied to the third node N3, in accordance with the sampling signal SAM. In the sampling transistor Tsam, the sampling signal SAM is applied to the gate electrode, the third node N3 is connected to the first electrode, and the second electrode is connected to the threshold voltage sensing unit 150. Therefore, when the sampling signal SAM is in a turn-on level, the sampling transistor Tsam is turned on to sample the voltage applied to the third node N3 which is the sensing line SL to the threshold voltage sensing unit 150.

The sensing transistor Tsen, the initializing transistor Tref, and the sampling transistor Tsam which constitute the sensing circuit perform a switching function so that the transistors may be replaced by a circuit element such as a diode which performs a switching function.

Hereinafter, a threshold voltage sensing method of an organic light emitting diode of the display device according to the embodiment of the present disclosure will be described with reference to FIGS. 4 and 5A to 5C.

Figure 4:
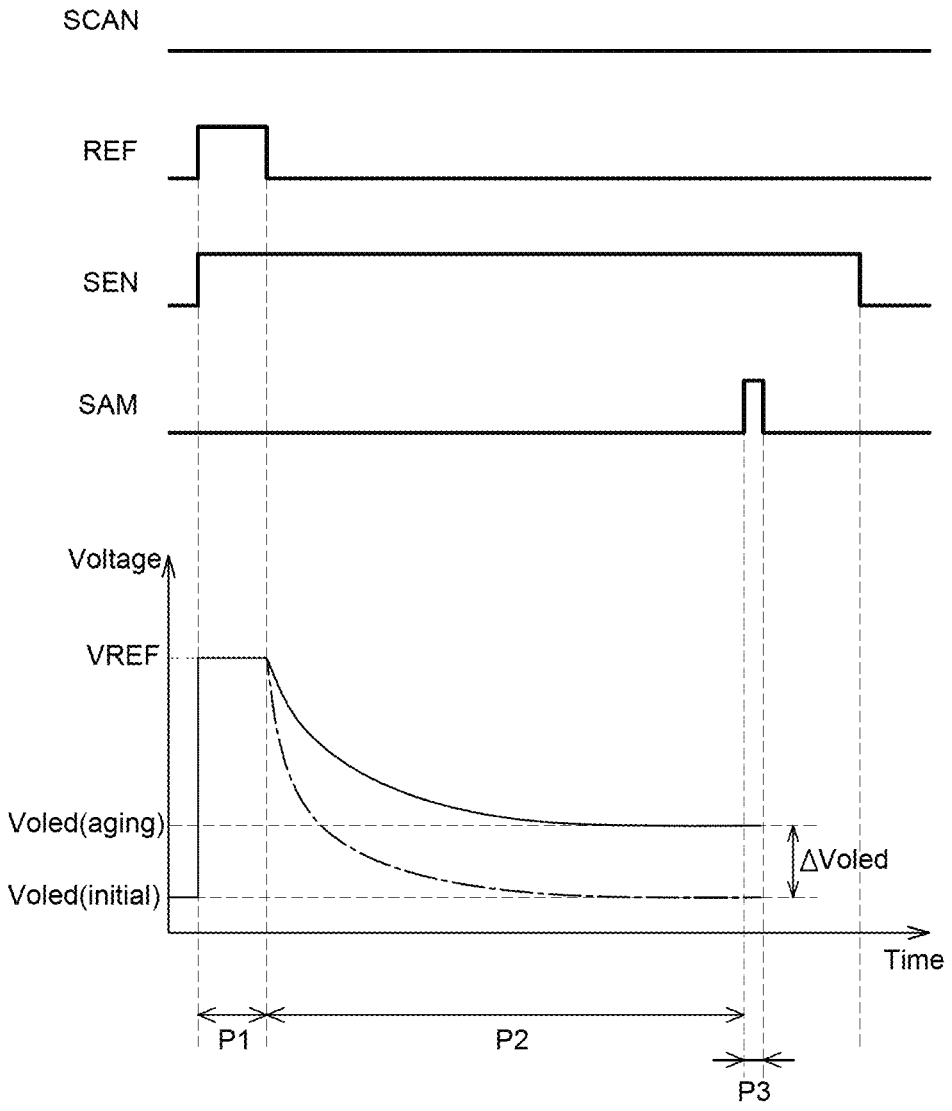
FIG. 4 is a graph illustrating a voltage of one electrode of an organic light emitting diode of a display device according to an embodiment of the present disclosure.

FIG. 4 is a graph illustrating a voltage of one electrode of an organic light emitting diode of a display device according to an embodiment of the present disclosure.

Figure 5A:
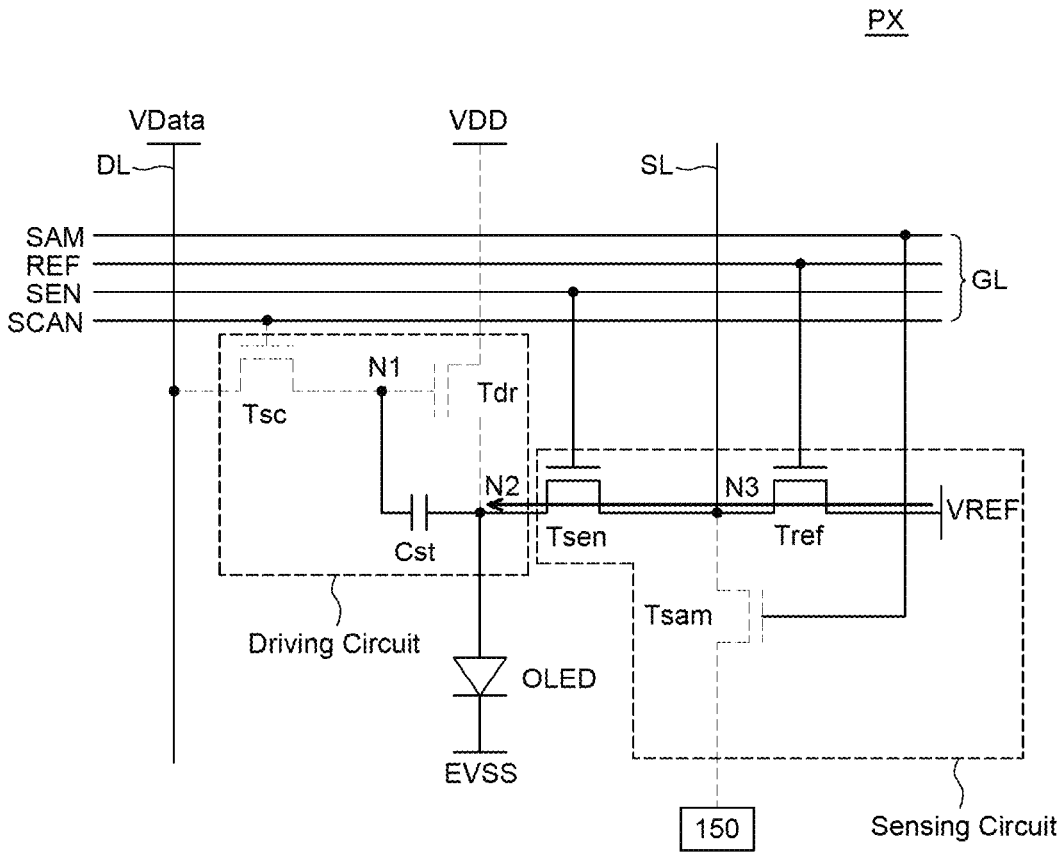
FIGS. 5A to 5C are circuit diagrams illustrating a threshold voltage sensing method of an organic light emitting diode of a display device according to an embodiment of the present disclosure.
Figure 5B:
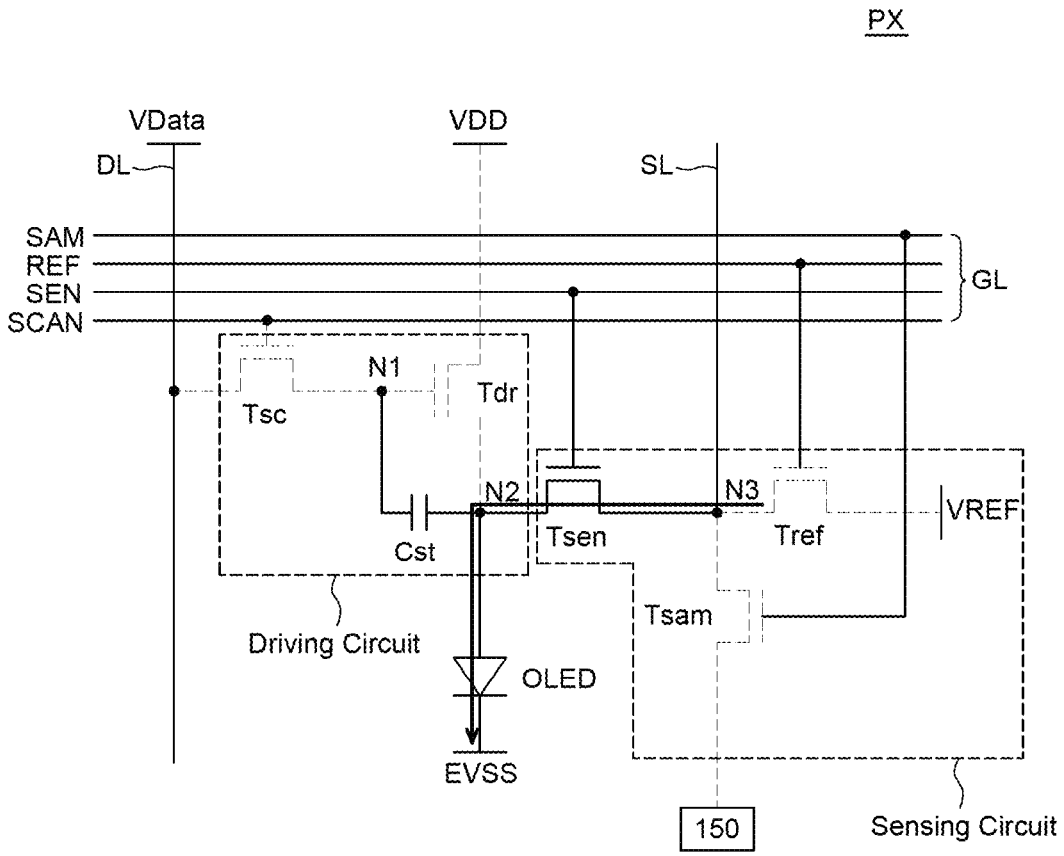
Figure 5C:
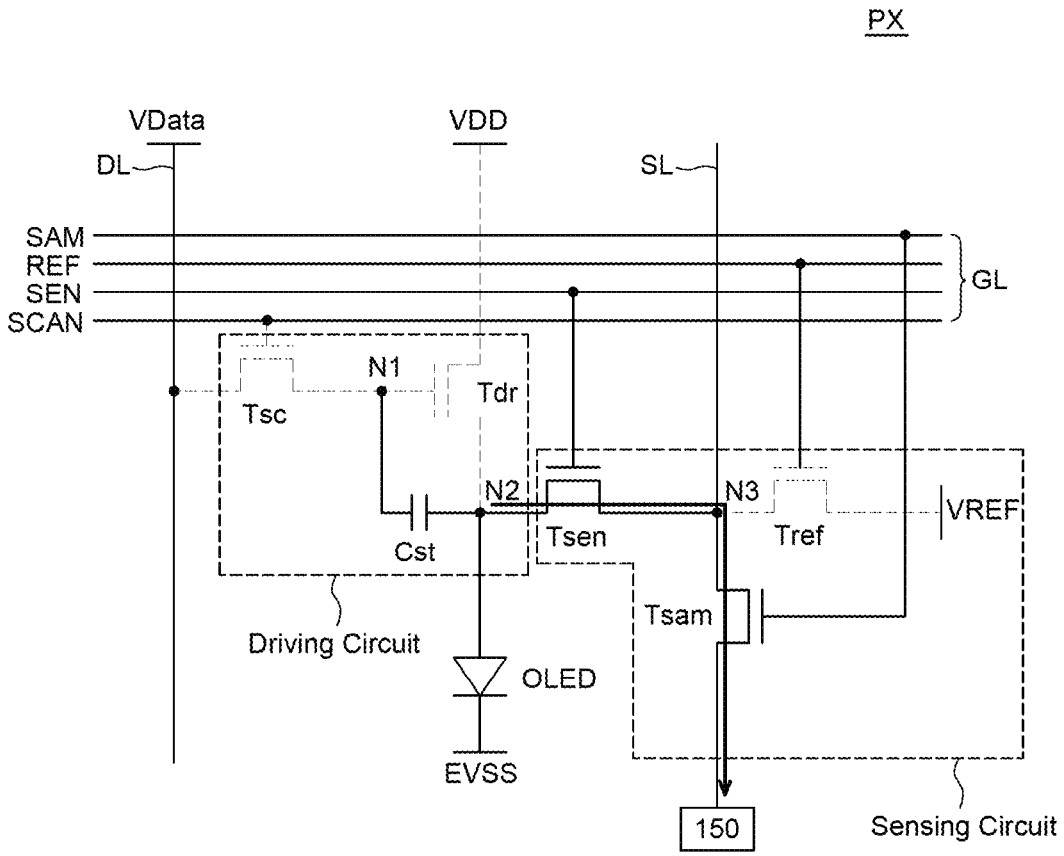

FIGS. 5A to 5C are circuit diagrams for explaining a threshold voltage sensing method of an organic light emitting diode of a display device according to an embodiment of the present disclosure.

As illustrated in FIG. 4, during a first period P1, a scan signal SCAN is in a turn-off level, an initialization signal REF is in a turn-on level, a sensing signal SEN is in a turn-on level, and a sampling signal SAM is in a turn-off level.

Therefore, referring to FIG. 5A, the sensing transistor Tsen and the initializing transistor Tref are turned on so that the initialization voltage VREF is charged in both the second node N2 and the third node N3.

The above-described initialization voltage VREF may be higher than a threshold voltage Voled of the organic light emitting diode OLED.

Next, as illustrated in FIG. 4, during a second period P2, the scan signal SCAN is in a turn-off level, the initialization signal REF is in a turn-off level, the sensing signal SEN is in a turn-on level, and the sampling signal SAM is in a turn-off level.

Therefore, referring to FIG. 5B, only the sensing transistor Tsen is turned on so that the second node N2 and the third node N3 are electrically connected. The initialization voltage VREF charged in the second node N2 and the third node N3 is higher than the threshold voltage Voled of the organic light emitting diode OLED. Accordingly, the organic light emitting diode OLED may allow the initialization voltage VREF applied to the second node N2 and the third node N3 to be discharged to be the threshold voltage Voled of the organic light emitting diode OLED. When the initialization voltage VREF applied to the second node N2 and the third node N3 is equal to the threshold voltage Voled of the organic light emitting diode OLED, the current does not flow through the organic light emitting diode OLED. Therefore, the voltages of the second node N2 and the third node N3 may be saturated to the threshold voltage Voled of the organic light emitting diode OLED.

With regard to this, the organic light emitting diode OLED is degraded while the aging is proceeded, so that an aging threshold voltage Voled (aging) of the organic light emitting diode OLED may be higher than an initial threshold voltage Voled (initial) of the organic light emitting diode OLED.

Next, as illustrated in FIG. 4, during a third period P3, the scan signal SCAN is in a turn-off level, the initialization signal REF is in a turn-off level, the sensing signal SEN is in a turn-on level, and the sampling signal SAM is in a turn-on level.

Therefore, referring to FIG. 5C, the sensing transistor Tsen and the sampling transistor Tsam are turned on so that the threshold voltage Voled of the organic light emitting diode OLED charged in the second node N2 and the third node N3 may be sampled to the threshold voltage sensing unit 150 through the sensing line SL. Therefore, the threshold voltage sensing unit 150 senses the initial threshold voltage Voled (initial) of the organic light emitting diode OLED and the aging threshold voltage Voled (aging) of the organic light emitting diode OLED to generate a threshold voltage variation ΔVoled corresponding to a difference between the initial threshold voltage Voled (initial) of the organic light emitting diode OLED and the aging threshold voltage Voled (aging) of the organic light emitting diode OLED.

Hereinafter, a dummy area of a display device according to an embodiment of the present disclosure will be described in detail with reference to FIGS. 6A and 6B.

Figure 6A:
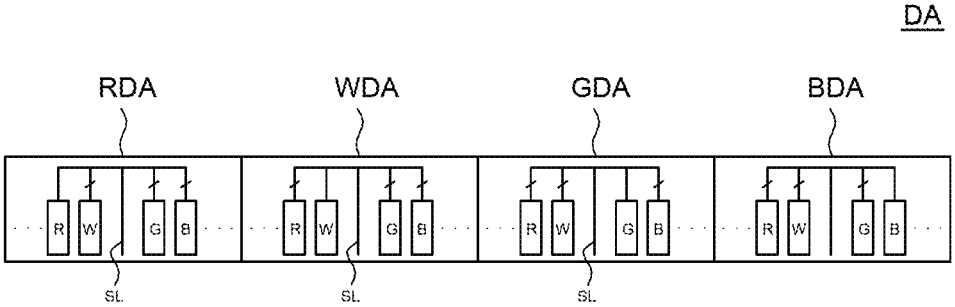
FIGS. 6A and 6B are block diagrams illustrating a dummy area of a display device according to an embodiment of the present disclosure.
Figure 6B:
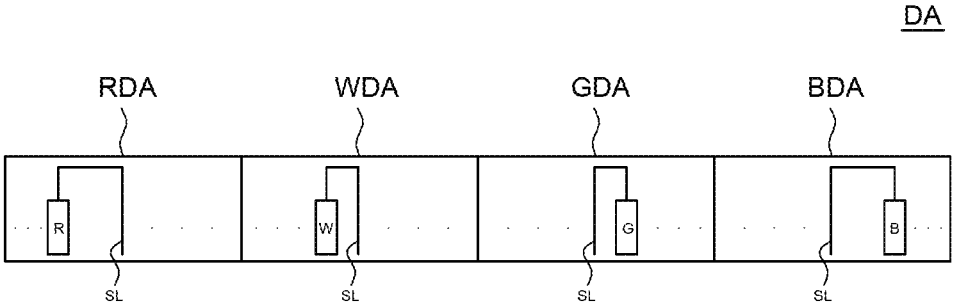

FIGS. 6A and 6B are block diagrams illustrating a dummy area of a display device according to an embodiment of the present disclosure.

As illustrated in FIGS. 6A and 6B, the dummy area DA includes a red sub dummy area RDA which implements a red pattern, a white sub dummy area WDA which implements a white pattern, a green sub dummy area GDA which implements a green pattern, and a blue sub dummy area BDA which implements a blue pattern.

Specifically, as illustrated in FIG. 6A, in each of the red sub dummy area RDA, the white sub dummy area WDA, the green sub dummy area GDA, and the blue sub dummy area BDA, all a red sub pixel R, a white sub pixel W, a green sub pixel G, and a blue sub pixel B may be disposed.

However, in the red sub dummy area RDA, only the red pattern is implemented so that only the red sub pixel R emits light and a threshold voltage of an organic light emitting diode disposed in the red sub pixel R is measured. Therefore, only the red sub pixel R is connected to the sensing line SL and the remaining sub pixels, that is, the white sub pixel W, the green sub pixel G, and the blue sub pixel B are not connected to the sensing line SL.

Similarly, in the white sub dummy area WDA, only the white pattern is implemented so that only the white sub pixel W emits light and a threshold voltage of an organic light emitting diode disposed in the white sub pixel W is measured. Therefore, only the white sub pixel W is connected to the sensing line SL and the remaining sub pixels, that is, the red sub pixel R, the green sub pixel G, and the blue sub pixel B are not connected to the sensing line SL.

Similarly, in the green sub dummy area GDA, only the green pattern is implemented so that only the green sub pixel G emits light and a threshold voltage of an organic light emitting diode disposed in the green sub pixel G is measured. Therefore, only the green sub pixel G is connected to the sensing line SL and the remaining sub pixels, that is, the red sub pixel R, the white sub pixel W, and the blue sub pixel B are not connected to the sensing line SL.

Similarly, in the blue sub dummy area BDA, only the blue pattern is implemented so that only the blue sub pixel B emits light and a threshold voltage of an organic light emitting diode disposed in the blue sub pixel B is measured. Therefore, only the blue sub pixel B is connected to the sensing line SL and the remaining sub pixels, that is, the red sub pixel R, the white sub pixel W, and the green sub pixel G are not connected to the sensing line SL.

Unlike this, as illustrated in FIG. 6B, in the red sub dummy area RDA, only the red sub pixel R is disposed and the red sub pixel R is connected to the sensing line SL. Further, in the white sub dummy area WDA, only the white sub pixel W is disposed and the white sub pixel W is connected to the sensing line SL. Further, in the green sub dummy area GDA, only the green sub pixel G is disposed and the green sub pixel G is connected to the sensing line SL. Further, in the blue sub dummy area BDA, only the blue sub pixel B is disposed and the blue sub pixel B is connected to the sensing line SL.

Therefore, in the red sub dummy area RDA, a variation ΔVoled of the threshold voltage of the organic light emitting diode disposed in the red sub pixel R due to the degradation may be measured. In the white sub dummy area WDA, a variation ΔVoled of the threshold voltage of the organic light emitting diode disposed in the white sub pixel W due to the degradation may be measured. Further, in the green sub dummy area GDA, a variation ΔVoled of the threshold voltage of the organic light emitting diode disposed in the green sub pixel G due to the degradation may be measured.

In the blue sub dummy area BDA, a variation ΔVoled of the threshold voltage of the organic light emitting diode disposed in the blue sub pixel B due to the degradation may be measured.

In each of the red sub dummy area RDA, the white sub dummy area WDA, the green sub dummy area GDA, and the blue sub dummy area BDA, a plurality of test patterns which implements different gray scales may be included to implement a gray scale pattern.

That is, in the red sub dummy area RDA, a plurality of red test patterns which expresses different gray scales may be disposed and in the white sub dummy area WDA, a plurality of white test patterns which expresses different gray scales may be disposed. Further, in the green sub dummy area GDA, a plurality of green test patterns which expresses different gray scales may be disposed and in the blue sub dummy area BDA, a plurality of blue test patterns which expresses different gray scales may be disposed. Each test pattern may include a plurality of sub pixels, but is not limited thereto and each test pattern may be configured by one sub pixel.

For example, in the red sub dummy area RDA, a plurality of red test patterns which expresses red with different gray scales may be disposed and in the white sub dummy area WDA, a plurality of white test patterns which expresses white with different gray scales may be disposed. Further, in the blue sub dummy area BDA, a plurality of blue test patterns which expresses blue with different gray scales and in the green sub dummy area GDA, a plurality of green test patterns which expresses green with different gray scales may be disposed.

Hereinafter, for the convenience of description, it is simplified such that a first pattern TP1, a second test pattern TP2, a third test pattern TP3, and a fourth test pattern TP4 which express the same color with different gray scales are disposed in the dummy area DA.

Hereinafter, a method of calculating a threshold voltage variation ΔVoled in accordance with degradation, in the first test pattern to fourth test pattern TP1 to TP4, will be described in more detail with reference to FIG. 7.

Figure 7:
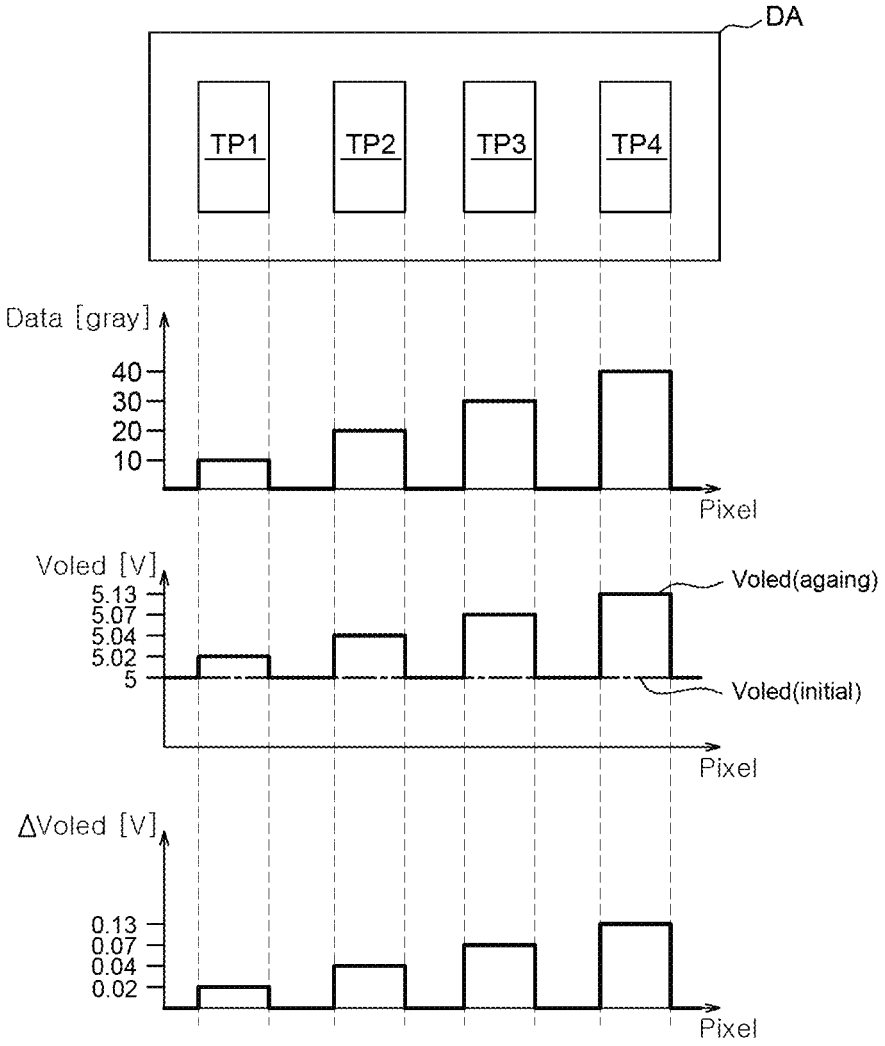
FIG. 7 is a view for explaining an operation of a threshold voltage sensing unit of a display device according to an embodiment of the present disclosure.

FIG. 7 is a view for explaining an operation of a threshold voltage sensing unit of a display device according to an embodiment of the present disclosure.

The threshold voltage sensing unit 150 senses a threshold voltage Voled of a light emitting diode included in a pixel PX which constitutes the plurality of test patterns.

Specifically, as illustrated in FIG. 7, in the dummy area DA, the first test pattern to the fourth test pattern TP1 to TP4 which express the same color, but implement different gray scales are disposed.

Specifically, a data signal Data which implements 10 gray scales may be output to the first test pattern TP1 and a data signal Data which implements 20 gray scales may be output to the second test pattern TP2. Further, a data signal Data which implements 30 gray scales may be output to the third test pattern TP3 and a data signal Data which implements 40 gray scales may be output to the fourth test pattern TP4.

The threshold voltage sensing unit 150 measures a threshold voltage Voled (initial) of the light emitting diode in an initial state, through the sensing line SL.

When the threshold voltage Voled (initial) of the light emitting diode is measured in the initial state, noises for erroneous sub pixel, among the plurality of sub pixels included in each of the first to fourth test patterns TP1 to TP4, are removed. Further, an average of the threshold voltages Voled of the plurality of remaining sub pixels excluding the erroneous sub pixel is derived to derive the threshold voltage Voled (initial) of the light emitting diode in the initial state.

That is, as illustrated in FIG. 7, the light emitting diode is not degraded in the initial state so that the threshold voltages Voled of the light emitting diodes measured in the first test pattern to the fourth test pattern TP1 to TP4 may be equal to each other.

For example, the threshold voltages Voled of the light emitting diodes measured in the first test pattern to the fourth test pattern TP1 to TP4 may be equal to each other, that is, 5 V.

Next, the threshold voltage sensing unit 150 measures a threshold voltage Voled (aging) of the light emitting diode in an aging state, through the sensing line SL.

When the threshold voltage Voled (aging) of the light emitting diode is measured in the aging state, noises for erroneous sub pixel, among the plurality of sub pixels included in each of the first to fourth test patterns TP1 to TP4, are removed. Further, an average of the threshold voltages Voled of the plurality of remaining sub pixels excluding the erroneous sub pixel is derived to derive the threshold voltage Voled (aging) of the light emitting diode in the aging state.

Further, when the threshold voltage Voled (aging) of the light emitting diode is measured in the aging state, a measured threshold voltage Voled may vary depending on external factors such as a measurement temperature so that a reference of the measured threshold voltage Voled is necessary. Accordingly, an area of the dummy area DA excluding the first test pattern to the fourth test pattern TP1 to TP4 is not degraded so that the threshold voltage Voled does not vary. Based on this, the threshold voltage Voled of the light emitting diode measured in each of the first test pattern to the fourth test pattern TP1 to TP4 is calculated with respect to a threshold voltage Voled of the light emitting diode measured in an area of the dummy area DA excluding the first test pattern to the fourth test pattern TP1 to TP4.

In the aging state, the first test pattern to the fourth test pattern TP1 to TP4 implement different gray scales so that the threshold voltages Voled of the light emitting diodes measured in the first test pattern to the fourth test pattern TP1 to TP4 may also vary. A threshold voltage Voled of a light emitting diode measured in the test pattern which expresses a high gray scale may be high.

For example, a threshold voltage Voled of a light emitting diode measured in the first test pattern TP1 may be 5.02 V, a threshold voltage Voled of a light emitting diode measured in the second test pattern TP2 may be 5.04 V, and a threshold voltage Voled of a light emitting diode measured in the third test pattern TP3 may be 5.07 V. Further, a threshold voltage Voled of a light emitting diode measured in the fourth test pattern TP4 may be 5.13 V.

The threshold voltage sensing unit 150 calculates a threshold voltage variation ΔVoled corresponding to a variation ΔVoled of the threshold voltage Voled (initial) of the light emitting diode in the initial state and the threshold voltage Voled (aging) of the light emitting diode in the aging state.

For example, a threshold voltage variation ΔVoled of a light emitting diode measured in the first test pattern TP1 may be 0.02 V and a threshold voltage variation ΔVoled of a light emitting diode measured in the second test pattern TP2 may be 0.04 V. A threshold voltage variation ΔVoled of a light emitting diode measured in the third test pattern TP3 may be 0.07 V and a threshold voltage variation ΔVoled of a light emitting diode measured in the fourth test pattern TP4 may be 0.13 V.

Hereinafter, the data compensating unit of the display device according to the embodiment of the present disclosure will be described in more detail with reference to FIG. 8.

Figure 8:
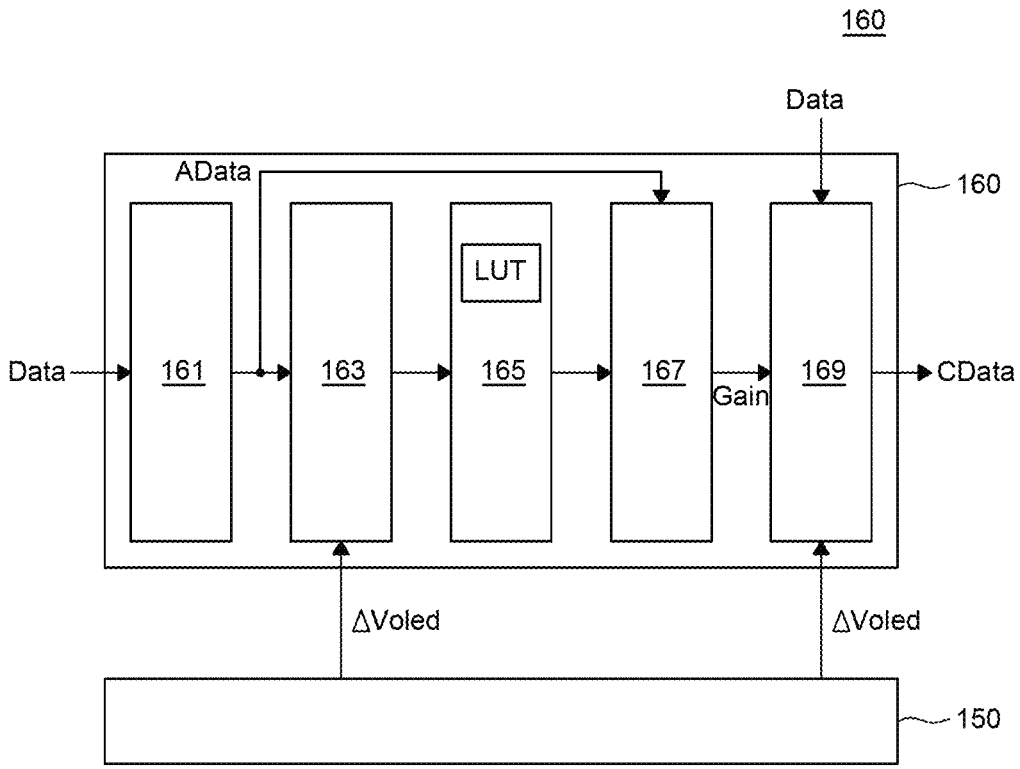
FIG. 8 is a block diagram illustrating a data compensating unit of a display device according to an embodiment of the present disclosure.

FIG. 8 is a block diagram illustrating a data compensating unit of a display device according to an embodiment of the present disclosure.

As illustrated in FIG. 8, the data compensating unit 160 includes a data counting unit 161 (or a data counting circuit 161), a standard gain setting unit 163 (or a standard gain setting circuit 163), a memory unit 165 (or memory 165), a gain correcting unit 167 (or a gain correcting circuit 167), and a gain applying unit 169 (or a gain applying circuit 169).

The data counting unit 161 counts and accumulates data signals Data to generate accumulated data AData.

The data counting unit 161 not simply counts and adds the data signals Data, but multiplies the data signals Data by a weighted coefficient and adds a correction constant thereto, and then adds them as much as a degradation time to calculate the accumulated data Adata. That is, the accumulated data Adata may be calculated by Equation 1.

$$\text{Accumulated data } (A\text{data}) = \Sigma((\text{Weighted coefficient } (\alpha) \times \text{Data signal (Data)} + \text{Correction constant } (\Phi)) \quad \text{[Equation 1]}$$

Here, the weighted coefficient Φ is determined in accordance with the data signal Data. That is, in order to express a high gray scale, the higher the intensity of the data signal Data is, the higher the weighted coefficient α is. To be more specific, the higher the expressed gray scale is, the greater the degree of degradation of the light emitting diode is. Therefore, by reflecting this, the higher the intensity of the data signal Data is, the higher the weighted coefficient α is.

The correction constant Φ is a constant which reflects a deviation for a temperature of the display panel 110 and the process of the display panel 110.

Hereinafter, a method of calculating the accumulated data Adata in the first test pattern to fourth test pattern TP1 to TP4 will be described in more detail with reference to FIG. 9.

Figure 9:
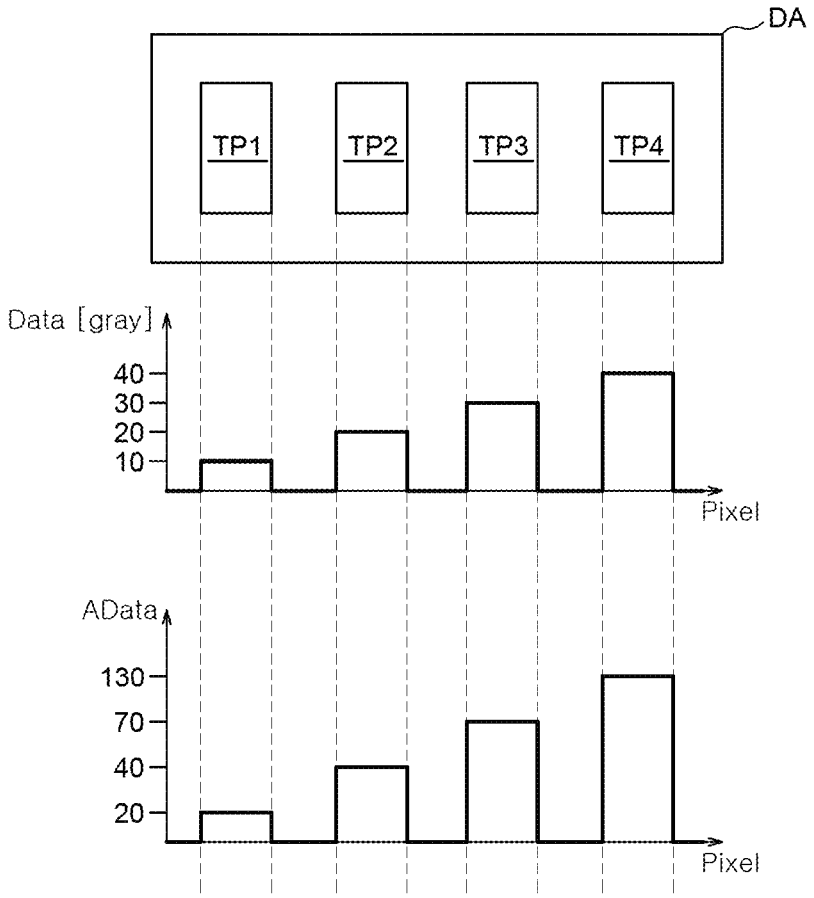
FIG. 9 is a graph for explaining an operation of a data counting unit of a display device according to an embodiment of the present disclosure.

FIG. 9 is a graph for explaining an operation of a data counting unit of a display device according to an embodiment of the present disclosure.

As illustrated in FIG. 9, in the dummy area DA, the first test pattern to fourth test pattern TP1 to TP4 which express the same color, but implement different gray scales are disposed.

Specifically, a data signal Data which implements 10 gray scales may be output to the first test pattern TP1 and a data signal Data which implements 20 gray scales may be output to the second test pattern TP2. Further, a data signal Data which implements 30 gray scales may be output to the third test pattern TP3 and a data signal Data which implements 40 gray scales may be output to the fourth test pattern TP4.

Therefore, a weighted coefficient α applied to the first test pattern TP1 may be 1, a weighted coefficient α applied to the second test pattern TP2 may be 1.5, a weighted coefficient α applied to the third test pattern TP3 may be 2, and a weighted coefficient α applied to the fourth test pattern TP4 may be 3.

When it is assumed that all the correction constants Φ are 10, accumulated data Adata for the first test pattern TP1 per unit time is 20, accumulated data Adata for the second test pattern TP2 per unit time is 40, accumulated data Adata for the third test pattern TP3 per unit time is 70, and accumulated data Adata for the fourth test pattern TP4 per unit time is 130.

Figure 10:
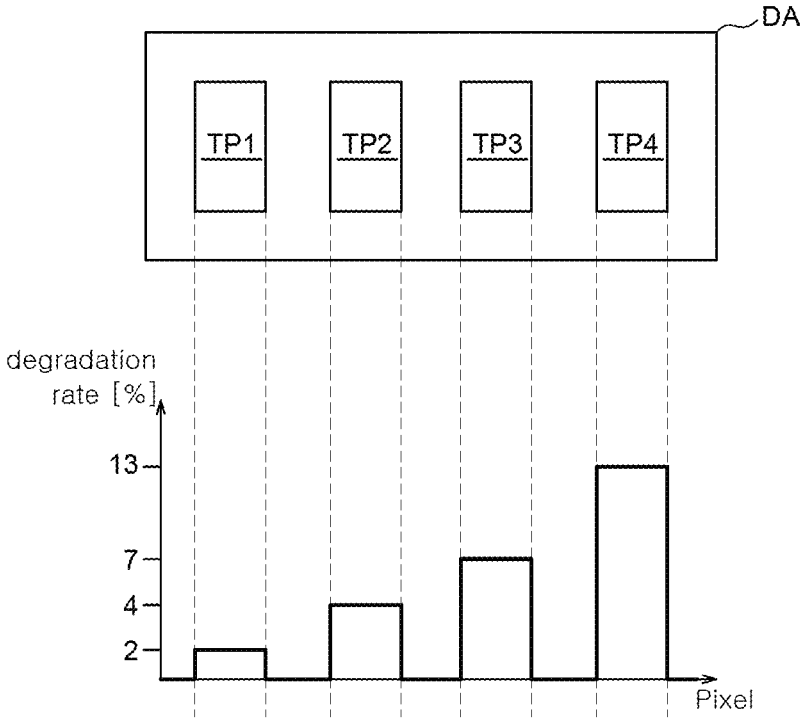
FIG. 10 is a graph for explaining an operation of a standard gain setting unit of a display device according to an embodiment of the present disclosure.

FIG. 10 is a graph for explaining an operation of a standard gain setting unit of a display device according to an embodiment of the present disclosure.

Figure 11A:
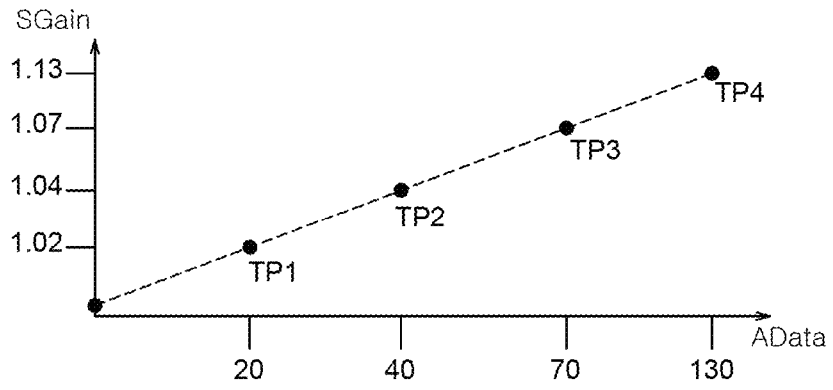
FIG. 11A is a graph for explaining a relationship of a standard gain and accumulated data of a display device according to an embodiment of the present disclosure.

FIG. 11A is a graph for explaining a relationship of a standard gain and accumulated data of a display device according to an embodiment of the present disclosure.

Figure 11B:
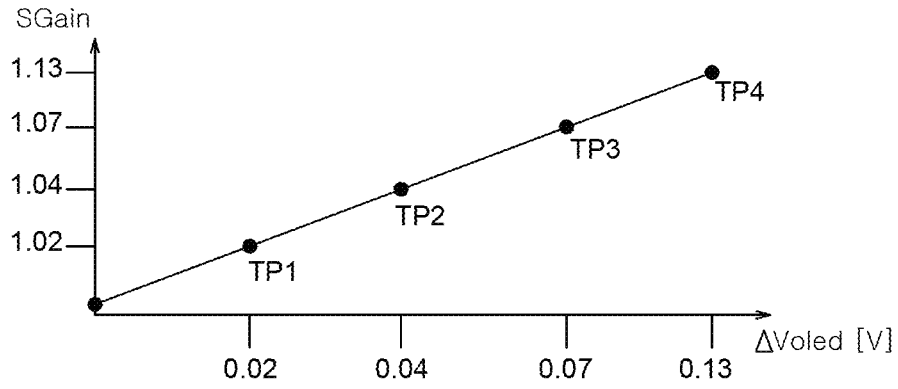
FIG. 11B is a graph for explaining a relationship of a standard gain and a threshold voltage variation of a display device according to an embodiment of the present disclosure.

FIG. 11B is a graph for explaining a relationship of a standard gain and a threshold voltage variation of a display device according to an embodiment of the present disclosure.

The standard gain setting unit 163 determines a degradation degree of each test pattern during the aging period to calculate a standard gain SGain to be applied to each test pattern. The standard gain setting unit 163 derives a relationship between the standard gain SGain and accumulated data Adata and a relationship between the standard gain SGain and the threshold voltage variation ΔVoled, for each test pattern.

That is, after setting a standard gain SGain for each of the first test pattern to fourth test pattern TP1 to TP4, the standard gain setting unit 163 sets the relationship between the standard gain SGain and accumulated data Adata and the relationship between the standard gain SGain and the threshold voltage variation ΔVoled, for each of the first test pattern to fourth test pattern TP1 to TP4.

Specifically, the standard gain setting unit 163 calculates 1+degradation rate (%) for each test pattern to calculate a standard gain SGain.

The above-mentioned degradation rate (%) may be derived as (target luminance−output luminance)/target luminance×100.

Here, the target luminance refers to an initial luminance which may be output if the degradation is not proceeded and the output luminance refers to a current luminance which is output after the degradation is not proceeded.

Hereinafter, calculation of the standard gain SGain for each of the first test pattern to fourth test pattern TP1 to TP4 will be described in detail.

As illustrated in FIG. 10, when 1000 nit of luminance is output to the entire pixels PX of the dummy area DA, the first test pattern to fourth test pattern TP1 to TP4 which implement different gray scales during the aging period may output different luminances.

For example, the first test pattern TP1 may output 980 nit, the second test pattern TP2 may output 960 nit, the third test pattern TP3 may output 930 nit, and the fourth test pattern TP4 may output 870 nit.

Therefore, a degradation rate for the first test pattern TP1 is 2%, a degradation rate for the second test pattern TP2 is 4%, a degradation rate for the third test pattern TP3 is 7%, and a degradation rate for the fourth test pattern TP4 is 13%.

When the standard gain SGain is calculated based on this, the standard gain SGain for the first test pattern TP1 is 1.02, the standard gain SGain for the second test pattern TP2 is 1.04, the standard gain SGain for the third test pattern TP3 is 1.07, and the standard gain SGain for the fourth test pattern TP4 is 1.13.

Next, the standard gain setting unit 163 calculates a ratio of the accumulated data Adata of the first test pattern to the fourth test pattern TP1 to TP4 output from the data counting unit 161 and the standard gains SGain of the first test pattern to the fourth test pattern TP1 to TP4.

As described above, accumulated data Adata for the first test pattern TP1 per unit time is 20, accumulated data Adata for the second test pattern TP2 per unit time is 40, accumulated data Adata for the third test pattern TP3 per unit time is 70, and accumulated data Adata for the fourth test pattern TP4 per unit time is 130.

Further, the standard gain SGain for the first test pattern TP1 is 1.02, the standard gain SGain for the second test pattern TP2 is 1.04, the standard gain SGain for the third test pattern TP3 is 1.07, and the standard gain SGain for the fourth test pattern TP4 is 1.13.

Therefore, as illustrated in FIG. 11A, when the accumulated data Adata per unit time is 20, the standard gain setting unit 163 matches the standard gain SGain to be 1.02 and when the accumulated data Adata per unit time is 40, the standard gain setting unit 163 matches the standard gain SGain to be 1.04. Further, when the accumulated data Adata per unit time is 70, the standard gain setting unit 163 matches the standard gain SGain to be 1.07 and when the accumulated data Adata per unit time is 130, the standard gain setting unit 163 matches the standard gain SGain to be 1.13.

As described above, the standard gain setting unit 163 calculates the relationship of the accumulated data Adata and the standard gain SGain to transmit the relationship to the memory unit 165.

However, even though in FIG. 11A, the relationship of the accumulated data Adata and the standard gain SGain is illustrated by a constant linear graph, the present disclosure is not limited thereto and the relationship of the accumulated data Adata and the standard gain SGain may be illustrated by a non-linear graph.

Next, the standard gain setting unit 163 calculates a ratio of the threshold voltage variation ΔVoled of the first test pattern to the fourth test pattern TP1 to TP4 output from the threshold voltage sensing unit 150 and the standard gains SGain of the first test pattern to the fourth test pattern TP1 to TP4.

As described above, a threshold voltage variation ΔVoled of a light emitting diode measured in the first test pattern TP1 may be 0.02 V and a threshold voltage variation ΔVoled of a light emitting diode measured in the second test pattern TP2 may be 0.04 V. A threshold voltage variation ΔVoled of a light emitting diode measured in the third test pattern TP3 may be 0.07 V and a threshold voltage variation ΔVoled of a light emitting diode measured in the fourth test pattern TP4 may be 0.13 V.

Further, the standard gain SGain for the first test pattern TP1 is 1.02, the standard gain SGain for the second test pattern TP2 is 1.04, the standard gain SGain for the third test pattern TP3 is 1.07, and the standard gain SGain for the fourth test pattern TP4 is 1.13.

Therefore, as illustrated in FIG. 11B, when the threshold voltage variation ΔVoled of the light emitting diode is 0.02 V, the standard gain setting unit 163 matches the standard gain SGain to be 1.02 and when the threshold voltage variation ΔVoled of the light emitting diode is 0.04 V, the standard gain setting unit 163 matches the standard gain SGain to be 1.04. Further, when the threshold voltage variation ΔVoled of the light emitting diode is 0.07 V, the standard gain setting unit 163 matches the standard gain SGain to be 1.07 and when the threshold voltage variation ΔVoled of the light emitting diode is 0.13 V, the standard gain setting unit 163 matches the standard gain SGain to be 1.13.

As described above, the standard gain setting unit 163 calculates the relationship of the threshold voltage variation ΔVoled and the standard gain SGain to transmit the relationship to the memory unit 165.

Even though in FIG. 11B, the relationship of the threshold voltage variation ΔVoled and the standard gain SGain is illustrated by a constant linear graph, the present disclosure is not limited thereto and the relationship of the threshold voltage variation ΔVoled and the standard gain SGain may be illustrated by a non-linear graph.

Figure 12:
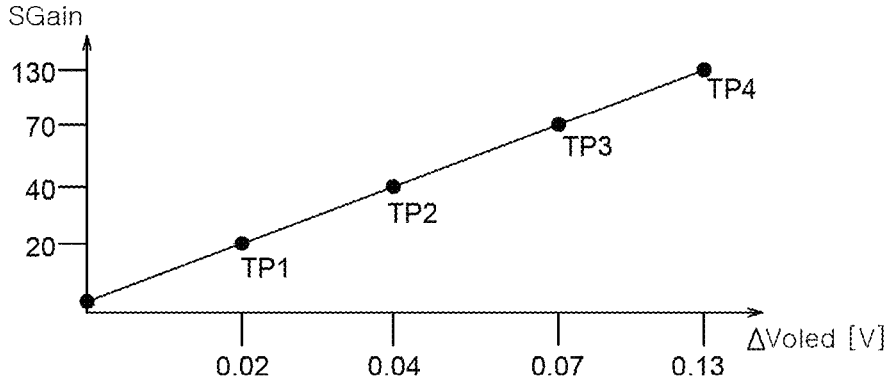
FIG. 12 is a graph for explaining a relationship of accumulated data and a threshold voltage variation of a display device according to an embodiment of the present disclosure.

FIG. 12 is a graph for explaining a relationship of accumulated data and a threshold voltage variation of a display device according to an embodiment of the present disclosure.

The memory unit 165 derives a relationship of the accumulated data Adata and the threshold voltage variation ΔVoled and stores the relationship in the look-up table LUT.

As described above, the standard gain setting unit 163 transmits the relationship of standard gain SGain and the accumulated data Adata and the relationship of the standard gain SGain and the threshold voltage Voled to the memory unit 165 during the aging period.

Therefore, the memory unit 165 derives the relationship of the accumulated data Adata and the threshold voltage variation ΔVoled based on the relationship of standard gain SGain and the accumulated data Adata and the relationship of the standard gain SGain and the threshold voltage variation ΔVoled during the aging period to generate the look-up table LUT.

For example, as described above, when the accumulated data Adata per unit time is 20, the standard gain SGain is 1.02 and when the accumulated data Adata per unit time is 40, the standard gain SGain is 1.04. Further, when the accumulated data Adata per unit time is 70, the standard gain SGain is 1.07 and when the accumulated data Adata per unit time is 130, the standard gain SGain is 1.13.

Further, when the threshold voltage variation ΔVoled of the light emitting diode is 0.02 V, the standard gain SGain is 1.02 and when the threshold voltage variation ΔVoled of the light emitting diode is 0.04 V, the standard gain SGain is 1.04. Further, when the threshold voltage variation ΔVoled of the light emitting diode is 0.07 V, the standard gain SGain is 1.07 and when the threshold voltage variation ΔVoled of the light emitting diode is 0.13 V, the standard gain SGain is 1.13.

Therefore, when the threshold voltage variation ΔVoled of the light emitting diode is 0.02 V, the memory unit 165 matches the accumulated data Adata per unit time to be 20 and when the threshold voltage variation ΔVoled of the light emitting diode is 0.04 V, the memory unit 165 matches the accumulated data Adata per unit time to be 40. Further, when the threshold voltage variation ΔVoled of the light emitting diode is 0.07 V, the memory unit 165 matches the accumulated data Adata per unit time to be 70 and when the threshold voltage variation ΔVoled of the light emitting diode is 0.13 V, the memory unit 165 matches the accumulated data Adata per unit time to be 130.

That is, the memory unit 165 calculates and stores the look-up table LUT for the relationship between the threshold voltage variation ΔVoled and the accumulated data Adata which becomes a standard for real-time gain correction during a predetermined aging period.

Figure 13A:
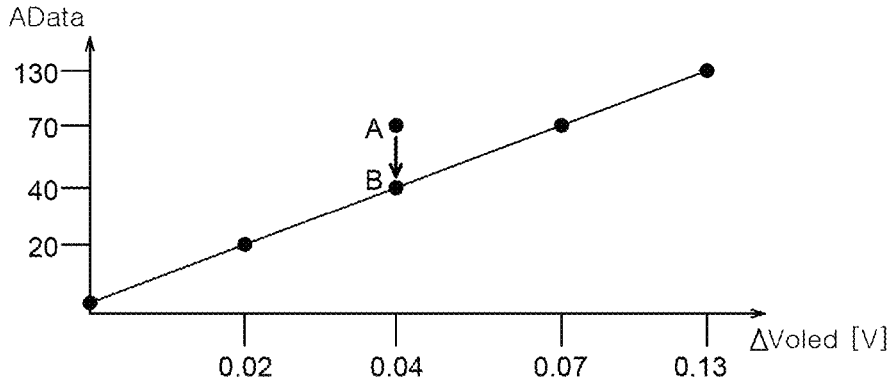
FIGS. 13A and 13B are graphs for explaining an operation of a gain correcting unit of a display device according to an embodiment of the present disclosure.
Figure 13B:
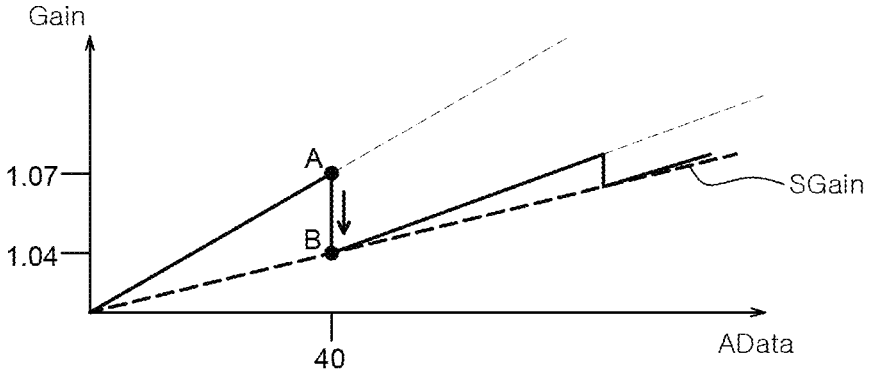

FIGS. 13A and 13B are graphs for explaining an operation of a gain correcting unit of a display device according to an embodiment of the present disclosure.

Specifically, FIG. 13A is a graph for explaining that the gain correcting unit corrects the accumulated data during the driving period and FIG. 13B is a graph for explaining that the gain correcting unit corrects the gain during the driving period.

The gain correcting unit 167 corrects a gain during the driving period based on the look-up table LUT stored in the memory unit 165.

That is, the gain correcting unit 167 is applied with the accumulated data Adata from the data counting unit 161 and is applied with the threshold voltage variation ΔVoled from the threshold voltage sensing unit 150, during the driving period. Thereafter, the gain correcting unit 167 compares the relationship of the accumulated data Adata and the threshold voltage variation ΔVoled with the look-up table LUT during the driving period to correct the accumulated data Adata and correct the gain so as to correspond to the corrected accumulated data.

To be more specific, the gain correcting unit 167 measures the accumulated data Adata and the threshold voltage variation ΔVoled during the driving period, respectively. Thereafter, the gain correcting unit 167 corrects the accumulated data Adata during the driving period so as to correspond to the look-up table LUT stored in the memory unit 165. Thereafter, the gain correcting unit 167 corrects the current gain with the standard gain in accordance with the corrected accumulated data.

For example, referring to FIG. 13A, at a predetermined timing during the driving period, as illustrated at the point A, the threshold voltage variation ΔVoled is 0.04 V and the accumulated data Adata may be measured as 70.

In contrast, according to the look-up table LUT in which the relationship of the threshold voltage variation ΔVoled and the accumulated data Adata is stored, as illustrated at the point B, when the threshold voltage variation ΔVoled is 0.04 V, the accumulated data Adata is 40.

That is, the accumulated data Adata during the driving period is more than the accumulated data Adata during the aging period based on the same threshold voltage variation ΔVoled so that it means that it is over-compensated during the driving period.

Therefore, the gain correcting unit 167 may correct the accumulated data Adata from 70 (the point A) to 40 (the point B) during the driving period so as to correspond to the look-up table LUT.

Therefore, the gain correcting unit 167 corrects the current gain Gain with the standard gain SGain in accordance with the corrected accumulated data.

Referring to FIG. 13B, in the current state (the point A), the gain is 1.07, but the standard gain SGain corresponding to the corrected accumulated data is 1.04, so that the gain Gain is corrected from 1.07 to 1.04.

That is, the gain correcting unit 167 corrects the gain Gain to suppress the over-compensation during the driving period.

Figure 14A:
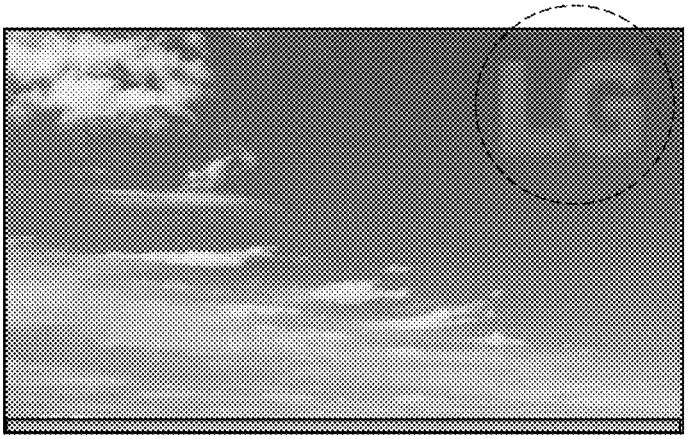
FIGS. 14A and 14B are views for explaining an operation of a gain applying unit of a display device according to an embodiment of the present disclosure.
Figure 14B:
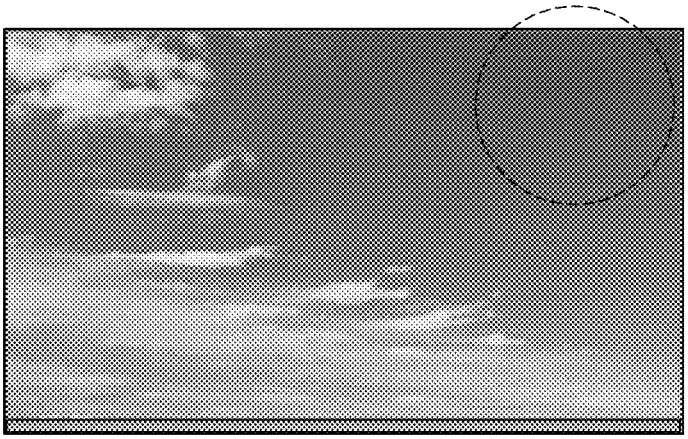

FIGS. 14A and 14B are views for explaining an operation of a gain applying unit of a display device according to an embodiment of the present disclosure.

Specifically, FIG. 14A illustrates that the display device according to the embodiment of the present disclosure is over-compensated and FIG. 14B illustrates that the over-compensated display device according to the embodiment of the present disclosure is corrected.

The gain applying unit 169 applies the gain Gain to the data signal Data to generate a corrected data signal CData.

That is, the gain applying unit 169 is applied with the data signal Data from the timing controller 140 and is applied with the corrected gain Gain from the gain correcting unit 167 to apply the corrected gain Gain to the data signal Data to generate a corrected data signal CData.

The corrected data signal CData is output to the data driver 120 so that the data driver 120 outputs the compensated data voltage Vdata to the display panel 110. Accordingly, the display device 100 according to the embodiment of the present disclosure suppresses the over-compensation to improve the image quality.

Specifically, as illustrated in FIG. 14A, the data signal Data is over-compensated in one area of the display panel 110 so that a logo with a high gray scale may remain at an upper right end as an afterimage. However, the data compensating unit 160 of the display device 100 according to the embodiment of the present disclosure periodically corrects the gain to match the standard gain SGain during the driving period. Therefore, as illustrated in FIG. 14B, in one area of the display panel 110, the afterimage due to the over-compensation or less-compensation of the data signal Data does not remain.

As a result, the display device 100 according to the embodiment of the present disclosure periodically determines whether the compensation of the data signal Data is appropriate by the test pattern disposed in the dummy area DA to suppress the erroneous compensation and improve the image quality.

Hereinafter, a driving method of a display device according to an embodiment of the present disclosure will be described in detail with reference to FIG. 15. The driving method of a display device according to an embodiment of the present disclosure will be described based on the above-described display device according to the embodiment of the present disclosure.

Figure 15:
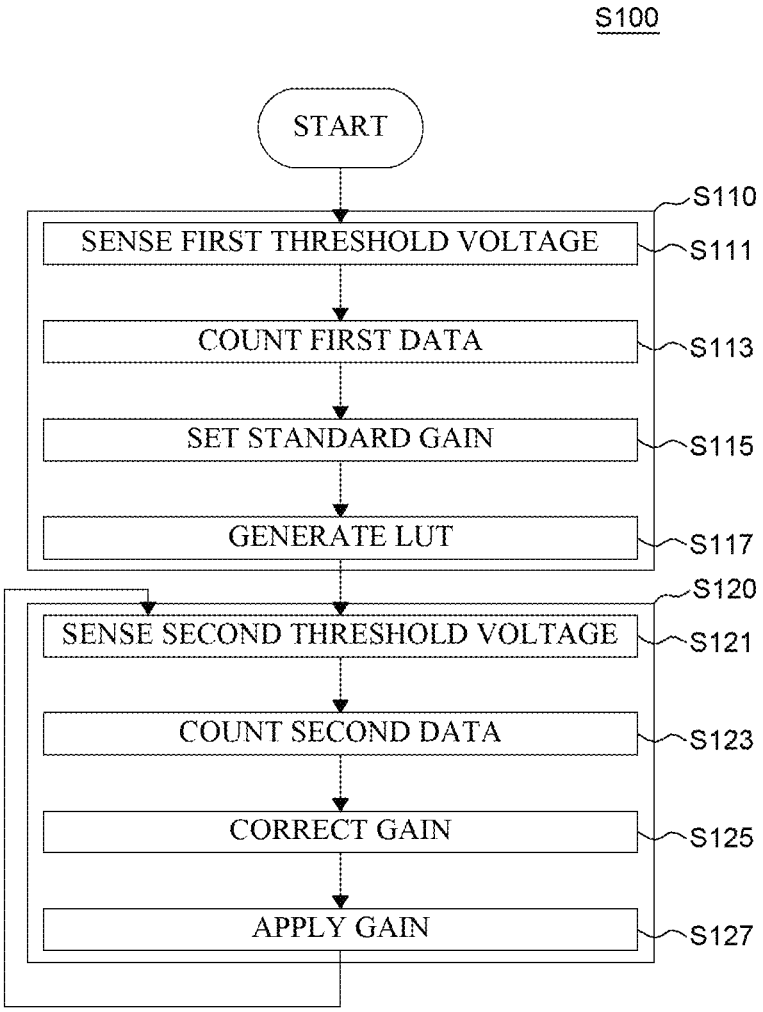
FIG. 15 is a flowchart for explaining a driving method of a display device according to an embodiment of the present disclosure.

FIG. 15 is a flowchart for explaining a driving method of a display device according to one embodiment of the present disclosure.

As illustrated in FIG. 15, a driving method S100 of a display device according to one embodiment of the present disclosure includes an aging step S110 of not only stabilizing a plurality of pixels PX but also generating a look-up table LUT in which a relationship of a variation ΔVoled of a threshold voltage of a light emitting diode included in each of the plurality of test patterns and the accumulated data AData is described and a driving step S120 which follows the aging step S110 and periodically corrects the data signal Data in accordance with the look-up table LUT and generates a corrected data signal CData.

The aging step S110 includes a first threshold voltage sensing step S111, a first data counting step S113, a standard gain setting step S115, and a look-up table generating step S117. The driving step S120 includes a second threshold voltage sensing step S121, a second data counting step S123, a gain correcting step S125, and a gain applying step S127.

In the first threshold voltage sensing step S111, a variation ΔVoled of the threshold voltage is sensed during the aging step S110.

That is, in the first threshold voltage sensing step S111, a threshold voltage Voled of a light emitting diode included in pixels PX which constitute a plurality of test patterns is sensed during the aging step S110.

Specifically, as illustrated in FIG. 7, in the dummy area DA, the first test pattern to fourth test pattern TP1 to TP4 which express the same color, but implement different gray scales are disposed.

Specifically, a data signal Data which implements 10 gray scales may be output to the first test pattern TP1 and a data signal Data which implements 20 gray scales may be output to the second test pattern TP2. Further, a data signal Data which implements 30 gray scales may be output to the third test pattern TP3 and a data signal Data which implements 40 gray scales may be output to the fourth test pattern TP4.

Further, in the first threshold voltage sensing step S111, a threshold voltage Voled (initial) of the light emitting diode in an initial state of the aging step S110 is measured.

When the threshold voltage Voled (initial) of the light emitting diode is measured in the initial state, noises for erroneous sub pixel, among the plurality of sub pixels included in each of the first to fourth test patterns TP1 to TP4, are removed. Further, an average of the threshold voltages Voled of the plurality of remaining sub pixels excluding the erroneous sub pixel is derived to derive the threshold voltage Voled (initial) of the light emitting diode in the initial state.

That is, as illustrated in FIG. 7, the light emitting diode is not degraded in the initial state so that the threshold voltages Voled of the light emitting diodes measured in the first test pattern to the fourth test pattern TP1 to TP4 may be equal to each other.

For example, the threshold voltages Voled of the light emitting diodes measured in the first test pattern to the fourth test pattern TP1 to TP4 may be equal to each other, that is, 5 V.

Next, in the first threshold voltage sensing step S111, a threshold voltage Voled (aging) of the light emitting diode in an aging state of the aging step S110 is measured.

When the threshold voltage Voled (aging) of the light emitting diode is measured in the aging state, noises for erroneous sub pixel, among the plurality of sub pixels included in each of the first to fourth test patterns TP1 to TP4, are removed. Further, an average of the threshold voltages Voled of the plurality of remaining sub pixels excluding the erroneous sub pixel is derived to derive the threshold voltage Voled (aging) of the light emitting diode in the aging state.

Further, when the threshold voltage Voled (aging) of the light emitting diode is measured in the aging state, a measured threshold voltage Voled may vary depending on external factors such as a measurement temperature so that a reference of the measured threshold voltage Voled is necessary. Accordingly, an area of the dummy area DA excluding the first test pattern to the fourth test pattern TP1 to TP4 is not degraded so that the threshold voltage Voled does not vary. Based on this, the threshold voltage Voled of the light emitting diode measured in each of the first test pattern to the fourth test pattern TP1 to TP4 is calculated with respect to a threshold voltage Voled of the light emitting diode measured in an area of the dummy area DA excluding the first test pattern to the fourth test pattern TP1 to TP4.

In the aging state, the first test pattern to the fourth test pattern TP1 to TP4 implement different gray scales so that the threshold voltages Voled of the light emitting diode measured in each of the first test pattern to the fourth test pattern TP1 to TP4 may also vary. A threshold voltage Voled of a light emitting diode measured in the test pattern which expresses a high gray scale may be high.

For example, a threshold voltage Voled of a light emitting diode measured in the first test pattern TP1 may be 5.02 V, a threshold voltage Voled of a light emitting diode measured in the second test pattern TP2 may be 5.04 V, and a threshold voltage Voled of a light emitting diode measured in the third test pattern TP3 may be 5.07 V. Further, a threshold voltage Voled of a light emitting diode measured in the fourth test pattern TP4 may be 5.13 V.

In the first threshold voltage sensing step S111, a threshold voltage variation ΔVoled corresponding to a variation ΔVoled of the threshold voltage Voled (initial) of the light emitting diode in the initial state and the threshold voltage Voled (aging) of the light emitting diode in the aging state are calculated.

For example, a threshold voltage variation ΔVoled of a light emitting diode measured in the first test pattern TP1 may be 0.02 V, a threshold voltage variation ΔVoled of a light emitting diode measured in the second test pattern TP2 may be 0.04 V, and a threshold voltage variation ΔVoled of a light emitting diode measured in the third test pattern TP3 may be 0.07 V. Further, a threshold voltage variation ΔVoled of a light emitting diode measured in the fourth test pattern TP4 may be 0.13 V.

Next, in the first data counting step S113, data signals Data are counted and accumulated during the aging step S110 to generate accumulated data AData.

In the first data counting step S113, the data signals Data are not simply counted and added during the aging step, but the data signals Data and a weighted coefficient are multiplied and a correction constant is added thereto, and then they are added as much as a degradation time to calculate the accumulated data Adata. That is, the accumulated data Adata may be calculated by Equation 1.

$$\text{Accumulated data}(A\text{data})=\Sigma((\text{Weighted coefficient}(\alpha)\times\text{Data signal(Data)}+\text{Correction constant}(\Phi)) \quad \text{[Equation 1]}$$

Here, the weighted coefficient α is determined in accordance with the data signal Data. That is, in order to express a high gray scale, the higher the intensity of the data signal Data is, the higher the weighted coefficient α is. To be more specific, the higher the expressed gray scale is, the greater the degree of degradation of the light emitting diode is. Therefore, by reflecting this, the higher the intensity of the data signal Data is, the higher the weighted coefficient α is.

The correction constant Φ is a constant which reflects a deviation for a temperature of the display panel 110 and the process of the display panel 110.

As illustrated in FIG. 9, in the dummy area DA, the first test pattern to fourth test pattern TP1 to TP4 which express the same color, but implement different gray scales are disposed.

Specifically, a data signal Data which implements 10 gray scales may be output to the first test pattern TP1 and a data signal Data which implements 20 gray scales may be output to the second test pattern TP2. Further, a data signal Data which implements 30 gray scales may be output to the third test pattern TP3 and a data signal Data which implements 40 gray scales may be output to the fourth test pattern TP4.

Therefore, a weighted coefficient α applied to the first test pattern TP1 may be 1, a weighted coefficient α applied to the second test pattern TP2 may be 1.5, a weighted coefficient α applied to the third test pattern TP3 may be 2, and a weighted coefficient α applied to the fourth test pattern TP4 may be 3.

When it is assumed that all the correction constants Φ are 10, accumulated data Adata for the first test pattern TP1 per unit time is 20, accumulated data Adata for the second test pattern TP2 per unit time is 40, accumulated data Adata for the third test pattern TP3 per unit time is 70, and accumulated data Adata for the fourth test pattern TP4 per unit time is 130.

Next, in the standard gain setting step S115, a degradation degree of each test pattern is determined during the aging step S110 to calculate a standard gain SGain to be applied to each test pattern. Further, in the standard gain setting step S115, a relationship between the standard gain SGain and accumulated data Adata and a relationship between the standard gain SGain and the threshold voltage variation ΔVoled are derived for each test pattern during the aging step S110.

That is, in the standard gain setting step S115, after setting the standard gain SGain for each of the first test pattern to fourth test pattern TP1 to TP4 during the aging step S110, the relationship between the standard gain SGain and accumulated data Adata and the relationship between the standard gain SGain and the threshold voltage variation ΔVoled are set for each of the first test pattern to fourth test pattern.

Specifically, in the standard gain setting step S115, 1+degradation rate (%) for each test pattern is calculated to calculate a standard gain SGain.

The above-mentioned degradation rate (%) may be derived as (target luminance−output luminance)/target luminance×100.

Here, the target luminance refers to an initial luminance which may be output if the degradation is not proceeded and the output luminance refers to a current luminance which is output after the degradation is not proceeded.

Hereinafter, calculation of the standard gain SGain for each of the first test pattern to fourth test pattern TP1 to TP4 will be described in detail.

As illustrated in FIG. 10, when 1000 nit of luminance is output to the entire pixels PX of the dummy area DA, the first test pattern to fourth test pattern TP1 to TP4 which implement different gray scales during the aging period may output different luminances.

For example, the first test pattern TP1 outputs 980 nit, the second test pattern TP2 outputs 960 nit, the third test pattern TP3 outputs 930 nit, and the fourth test pattern TP4 outputs 870 nit.

Therefore, a degradation rate for the first test pattern TP1 is 2%, a degradation rate for the second test pattern TP2 is 4%, a degradation rate for the third test pattern TP3 is 7%, and a degradation rate for the fourth test pattern TP4 is 13%.

When the standard gain SGain is calculated based on this, the standard gain SGain for the first test pattern TP1 is 1.02, the standard gain SGain for the second test pattern TP2 is 1.04, the standard gain SGain for the third test pattern TP3 is 1.07, and the standard gain SGain for the fourth test pattern TP4 is 1.13.

Next, in the standard gain setting step S115, a ratio of the accumulated data Adata of the first test pattern to the fourth test pattern TP1 to TP4 calculated in the first data counting step S113 and the standard gains SGain of the first test pattern to the fourth test pattern TP1 to TP4 is calculated during the aging step S110.

As described above, accumulated data Adata for the first test pattern TP1 per unit time is 20, accumulated data Adata for the second test pattern TP2 per unit time is 40, accumulated data Adata for the third test pattern TP3 per unit time is 70, and accumulated data Adata for the fourth test pattern TP4 per unit time is 130.

Further, the standard gain SGain for the first test pattern TP1 is 1.02, the standard gain SGain for the second test pattern TP2 is 1.04, the standard gain SGain for the third test pattern TP3 is 1.07, and the standard gain SGain for the fourth test pattern TP4 is 1.13.

Therefore, as illustrated in FIG. 11A, in the standard gain setting step S115, when the accumulated data Adata per unit time is 20 during the aging step S110, the standard gain SGain matches 1.02 and when the accumulated data Adata per unit time is 40, the standard gain SGain matches 1.04. Further, when the accumulated data Adata per unit time is 70, the standard gain SGain matches 1.07 and when the accumulated data Adata per unit time is 130, the standard gain SGain matches 1.13.

As described above, in the standard gain setting step S115, during the aging step S110, the relationship of the accumulated data Adata and the standard gain SGain is calculated.

Even though in FIG. 11A, the relationship of the accumulated data Adata and the standard gain SGain is illustrated by a constant linear graph, the present disclosure is not limited thereto and the relationship of the accumulated data Adata and the standard gain SGain may be illustrated by a non-linear graph.

Next, in the standard gain setting step S115, a ratio of the threshold voltage variation ΔVoled of the first test pattern to the fourth test pattern TP1 to TP4 calculated in the first threshold voltage sensing step S111 and the standard gains SGain of the first test pattern to the fourth test pattern TP1 to TP4 is calculated.

As described above, a threshold voltage variation ΔVoled of a light emitting diode measured in the first test pattern TP1 may be 0.02 V, a threshold voltage variation ΔVoled of a light emitting diode measured in the second test pattern TP2 may be 0.04 V, and a threshold voltage variation ΔVoled of a light emitting diode measured in the third test pattern TP3 may be 0.07 V. Further, a threshold voltage variation ΔVoled of a light emitting diode measured in the fourth test pattern TP4 may be 0.13 V.

Further, the standard gain SGain for the first test pattern TP1 is 1.02, the standard gain SGain for the second test pattern TP2 is 1.04, the standard gain SGain for the third test pattern TP3 is 1.07, and the standard gain SGain for the fourth test pattern TP4 is 1.13.

Therefore, as illustrated in FIG. 11B, in the standard gain setting step S115, when the threshold voltage variation ΔVoled of the light emitting diode is 0.02 V during the aging step S110, the standard gain SGain matches to be 1.02 and when the threshold voltage variation ΔVoled of the light emitting diode is 0.04 V, the standard gain SGain matches to be 1.04. Further, when the threshold voltage variation ΔVoled of the light emitting diode is 0.07 V, the standard gain SGain matches to be 1.07 and when the threshold voltage variation ΔVoled of the light emitting diode is 0.13 V, the standard gain SGain matches to be 1.13.

As described above, in the standard gain setting step S115, during the aging step S110, the relationship of the threshold voltage variation ΔVoled of the light emitting diode and the standard gain SGain is calculated.

Even though in FIG. 11B, the relationship of the threshold voltage variation ΔVoled and the standard gain SGain is illustrated by a constant linear graph, the present disclosure is not limited thereto and the relationship of the threshold voltage variation ΔVoled and the standard gain SGain may be illustrated by a non-linear graph.

In the look-up table generating step S117, a relationship of the accumulated data Adata and the threshold voltage variation ΔVoled is derived to generate the look-up table LUT.

As described above, in the standard gain setting step S115, during the aging step S110, the relationship of standard gain SGain and the accumulated data Adata and the relationship of the standard gain SGain and the threshold voltage variation ΔVoled are calculated.

Therefore, in the look-up table generating step S117, during the aging period, the relationship of the accumulated data Adata and the threshold voltage variation ΔVoled is derived based on the relationship of standard gain SGain and the accumulated data Adata and the relationship of the standard gain SGain and the threshold voltage variation ΔVoled to generate the look-up table LUT.

For example, as described above, when the accumulated data Adata per unit time is 20, the standard gain SGain is 1.02 and when the accumulated data Adata per unit time is 40, the standard gain SGain is 1.04. Further, when the accumulated data Adata per unit time is 70, the standard gain SGain is 1.07 and when the accumulated data Adata per unit time is 130, the standard gain SGain is 1.13.

Further, when the threshold voltage variation ΔVoled of the light emitting diode is 0.02 V, the standard gain SGain is 1.02 and when the threshold voltage variation ΔVoled of the light emitting diode is 0.04 V, the standard gain SGain is 1.04. Further, when the threshold voltage variation ΔVoled of the light emitting diode is 0.07 V, the standard gain SGain is 1.07 and when the threshold voltage variation ΔVoled of the light emitting diode is 0.13 V, the standard gain SGain is 1.13.

Therefore, in the look-up table generating step S117, when the threshold voltage variation ΔVoled of the light emitting diode is 0.02 V, the accumulated data Adata per unit time matches to be 20 and when the threshold voltage variation ΔVoled of the light emitting diode is 0.04 V, the accumulated data Adata per unit time matches to be 40. Further, when the threshold voltage variation ΔVoled of the light emitting diode is 0.07 V, the accumulated data Adata per unit time matches to be 70 and when the threshold voltage variation ΔVoled of the light emitting diode is 0.13 V, the accumulated data Adata per unit time matches to be 130.

That is, in the look-up table generating step S117, during the aging step S110, the look-up table LUT for the relationship between the threshold voltage variation ΔVoled and the accumulated data Adata which becomes a standard for real-time gain correction may be calculated.

Next, the second threshold voltage sensing step S121 and the second data counting step S123 of the driving step S120 are different from the first threshold voltage sensing step S111 and the first data counting step S111 described above in that the sensing timing is in the driving step S120, rather than the aging step S110. However, the sensing method is the same so that a redundant description will be omitted. Hereinafter, the gain correcting step S125 and the gain applying step S127 will be described in more detail.

In the gain correcting step S125, a gain Gain is corrected during the driving period based on the look-up table LUT.

That is, in the gain correcting step S125, during the driving step S120, the accumulated data Adata is calculated in the second data counting step S123 and the threshold voltage variation ΔVoled is calculated in the second threshold voltage sensing step S121. Thereafter, during the driving step S120, the relationship of the accumulated data Adata and the threshold voltage variation ΔVoled is compared with the look-up table LUT to correct the accumulated data Adata and correct the gain Gain so as to correspond to the corrected accumulated data.

To be more specific, in the gain correcting step S125, the accumulated data Adata and the threshold voltage variation ΔVoled are respectively measured during the driving step S120. Thereafter, in the gain correcting step S125, the accumulated data Adata during the driving period is corrected so as to correspond to the look-up table LUT. Thereafter, in the gain correcting step S125, the current gain Gain is corrected with the standard gain in accordance with the corrected accumulated data.

For example, referring to FIG. 13A, at a predetermined timing during the driving step S120, as illustrated at the point A, the threshold voltage variation ΔVoled is 0.04 V and the accumulated data Adata may be measured as 70.

In contrast, according to the look-up table LUT, as illustrated at the point B, when the threshold voltage variation ΔVoled is 0.04 V, the accumulated data Adata is 40.

That is, the accumulated data Adata during the driving step S120 is more than the accumulated data Adata during the aging period based on the same threshold voltage variation ΔVoled so that it means that it is over-compensated during the driving step S120.

Therefore, in the gain correcting step S125, the accumulated data Adata is corrected from 70 (the point A) to 40 (the point B) during the driving period so as to correspond to the look-up table LUT.

Accordingly, in the gain correcting step S125, the current gain Gain is corrected with the standard gain SGain in accordance with the corrected accumulated data.

Referring to FIG. 13B, in the current state (the point A) the gain is 1.07, but the standard gain SGain corresponding to the corrected accumulated data is 1.04, so that the gain Gain is corrected from 1.07 to 1.04.

That is, in the gain correcting step S125, the gain Gain is corrected to suppress the over-compensation during the driving step S120.

In the gain applying step S127, the gain Gain is applied to the data signal Data to generate a corrected data signal CData.

That is, in the gain applying step S127, the corrected gain Gain is applied to the data signal Data to generate a corrected data signal CData.

The corrected data signal CData is output to the data driver 120 so that the data driver 120 outputs the compensated data voltage Vdata to the display panel 110. Accordingly, the driving method S100 of the display device according to the embodiment of the present disclosure suppresses the over-compensation to improve the image quality.

Further, after finishing the gain applying step S127, the second threshold voltage sensing step S121 is periodically repeated to periodically correct the gain Gain. That is, in the driving method S100 of the display device according to the embodiment of the present disclosure, the gain may be periodically repeatedly corrected based on the look-up table LUT.

Therefore, as illustrated in FIG. 14A, the data signal Data is over-compensated in one area of the display panel 110 so that a logo with a high gray scale may remain at an upper right end as an afterimage. However, the driving method S100 of the display device according to the embodiment of the present disclosure periodically corrects the gain to match the standard gain SGain during the driving step S120. Therefore, as illustrated in FIG. 14B, in one area of the display panel 110, the afterimage due to the over-compensation or less-compensation of the data signal Data does not remain.

As a result, the driving method S100 of the display device according to the embodiment of the present disclosure periodically determines whether the compensation of the data signal Data is appropriate by the test pattern disposed in the dummy area DA to suppress the erroneous compensation and improve the image quality.

The embodiments of the present disclosure can also be described as follows:

According to an aspect of the present disclosure, a display device includes a display panel which includes a plurality of pixels; a threshold voltage sensing unit which senses a threshold voltage of a light emitting diode included in the plurality of pixels; a data compensating unit which corrects a data signal in accordance with a variation of the threshold voltage and accumulated data to generate a corrected data signal; and a data driver which generates a data voltage in accordance with the corrected data signal to output the data voltage to the display panel, in which the data compensating unit periodically corrects the data signal in accordance with a look-up table in which a relationship of the variation of the threshold voltage and the accumulated data is described during an aging period to generate the corrected data signal, thereby improving an image quality.

The display panel may include an active area and a dummy area disposed at least one side portion of the active area, the dummy area is divided into a plurality of sub dummy areas, and a plurality of test patterns which expresses the same color with different gray scales is disposed in each of the plurality of sub dummy areas.

The dummy area may be blocked by a finishing material so as not to be exposed to the outside.

The dummy area may be divided into a red sub dummy area, a white sub dummy area, a green sub dummy area, and a blue sub dummy area, in the red sub dummy area, a plurality of red test patterns which expresses red with different gray scales is disposed, in the white sub dummy area, a plurality of white test patterns which expresses white with different gray scales is disposed, in the green sub dummy area, a plurality of green test patterns which expresses green with different gray scales is disposed, and in the blue sub dummy area, a plurality of blue test patterns which expresses blue with different gray scales is disposed.

The threshold voltage sensing unit may sense the variation of the threshold voltage of the light emitting diode included in a pixel which constitutes the plurality of test patterns.

The data compensating unit may be driven separately in an aging period in which the plurality of pixels is stabilized and a driving period in which the plurality of pixels is driven, and may include a data counting unit which counts and accumulates the data signal to generate the accumulated data, a standard gain setting unit which determines a degree of degradation of the plurality of test patterns during the aging period to set a standard gain for the plurality of test patterns, a memory unit which generates the look-up table during the aging period, a gain correcting unit which corrects a gain in accordance with the look-up table during the driving period and a gain applying unit which applies the corrected gain to the data signal to generate the corrected data signal.

The data counting unit may calculate the accumulated data by adding values obtained by multiplying the data signal by a weighted coefficient and adding a correction constant.

The higher an intensity of the data signal is, the higher the weighted coefficient is.

The standard gain setting unit derives a relationship of the standard gain and the accumulated data and a relationship of the standard gain and the variation of the threshold voltage for each of the plurality of test patterns.

The standard gain setting unit may calculate the standard gain by adding 1 and degradation rate (%).

The memory unit may generate the look-up table based on a relationship of the standard gain and the accumulated data and a relationship of the standard gain and the variation of the threshold voltage derived by the standard gain setting unit.

The gain correcting unit may correct the accumulated data by comparing a relationship of the accumulated data and the variation of the threshold voltage during the driving period with the look-up table and corrects the gain so as to correspond to the corrected accumulated data.

During the driving period, one frame may be divided into an active section, a dummy section, and a blank section, and in the dummy section, the plurality of test patterns disposed in the dummy area is driven.

Each of the plurality of pixels may include an organic light emitting diode which is the light emitting diode, a driving circuit which drives the organic light emitting diode; and a sensing circuit which senses the threshold voltage of the organic light emitting diode.

The driving circuit may include a driving transistor which applies a driving current to the organic light emitting diode, a scan transistor which applies the data voltage to a gate electrode of the driving transistor and a storage capacitor which maintains a gate-source voltage of the driving transistor for one frame.

The sensing circuit may include a sensing transistor which connects one electrode of the organic light emitting diode and a sensing line in accordance with a sensing signal, an initializing transistor which applies an initialization voltage to the sensing line in accordance with an initialization signal and a sampling transistor which applies a voltage applied to the sensing line to the threshold voltage sensing unit in accordance with a sampling signal.

Although the embodiments of the present disclosure have been described in detail with reference to the accompanying drawings, the present disclosure is not limited thereto and may be embodied in many different forms without departing from the technical concept of the present disclosure. Therefore, the embodiments of the present disclosure are provided for illustrative purposes only but not intended to limit the technical concept of the present disclosure. The scope of the technical concept of the present disclosure is not limited thereto. Therefore, it should be understood that the above-described embodiments are illustrative in all aspects and do not limit the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a display panel which includes a plurality of pixels, the plurality of pixels including a light emitting diode;

a threshold voltage sensing circuit which senses a threshold voltage of the light emitting diode;

a data compensating circuit configured to:

correct a data signal in accordance with a variation of the threshold voltage and accumulated data; and generate a corrected data signal; and a data driver configured to:

generate a data voltage in accordance with the corrected data signal; and output the data voltage to the display panel, wherein the data compensating circuit is further configured to periodically correct the data signal in accordance with a look-up table in which a relationship of the variation of the threshold voltage and the accumulated data is described to generate the corrected data signal, wherein the display panel includes an active area and a dummy area disposed in at least one side portion of the active area, the dummy area having a plurality of sub dummy areas, and a plurality of test patterns which expresses the same color with different gray scales is disposed in each of the plurality of sub dummy areas.

2. The display device according to claim 1, wherein the dummy area is at least partially blocked by a finishing material.

3. The display device according to claim 1, wherein the dummy area is divided into a red sub dummy area, a white sub dummy area, a green sub dummy area, and a blue sub dummy area, wherein the plurality of test patterns include a plurality of red, white, green, and blue test patterns, in the red sub dummy area, the plurality of red test patterns which expresses red with different gray scales is disposed, in the white sub dummy area, the plurality of white test patterns which expresses white with different gray scales is disposed, in the green sub dummy area, the plurality of green test patterns which expresses green with different gray scales is disposed, and in the blue sub dummy area, the plurality of blue test patterns which expresses blue with different gray scales is disposed.

4. The display device according to claim 1, wherein the threshold voltage sensing circuit senses the variation of the threshold voltage of the light emitting diode included in a pixel which constitutes the plurality of test patterns.

5. The display device according to claim 1, wherein the data compensating circuit is driven separately in an aging period in which the plurality of pixels is stabilized and a driving period in which the plurality of pixels is driven, and wherein the display device includes:

a data counting circuit which counts and accumulates the data signal to generate the accumulated data;

a standard gain setting circuit which determines a degree of degradation of the plurality of test patterns during the aging period to set a standard gain for the plurality of test patterns;

a memory which generates the look-up table during the aging period;

a gain correcting circuit which corrects a gain in accordance with the look-up table during the driving period; and a gain applying circuit which applies the corrected gain to the data signal to generate the corrected data signal.

6. The display device according to claim 5, wherein the data counting circuit calculates the accumulated data by adding values obtained by multiplying the data signal by a weighted coefficient and adding a correction constant.

7. The display device according to claim 6, wherein the higher an intensity of the data signal is, the higher the weighted coefficient is.

8. The display device according to claim 5, wherein the standard gain setting circuit derives a relationship of the standard gain and the accumulated data and a relationship of the standard gain and the variation of the threshold voltage for each of the plurality of test patterns.

9. The display device according to claim 5, wherein the standard gain setting circuit calculates the standard gain by adding 1 and degradation rate.

10. The display device according to claim 5, wherein the memory generates the look-up table based on a relationship of the standard gain and the accumulated data and a relationship of the standard gain and the variation of the threshold voltage derived by the standard gain setting circuit.

11. The display device according to claim 5, wherein the gain correcting circuit corrects the accumulated data by comparing a relationship of the accumulated data and the variation of the threshold voltage during the driving period with the look-up table and corrects the gain so as to correspond to the corrected accumulated data.

12. The display device according to claim 5, wherein during the driving period, one frame is divided into an active section, a dummy section, and a blank section, and in the dummy section, the plurality of test patterns disposed in the dummy area is driven.

13. The display device according to claim 1, wherein each of the plurality of pixels includes:

an organic light emitting diode which is the light emitting diode;

a driving circuit which drives the organic light emitting diode; and a sensing circuit which senses the threshold voltage of the organic light emitting diode.

14. The display device according to claim 13, wherein the driving circuit includes:

a driving transistor which applies a driving current to the organic light emitting diode;

a scan transistor which applies the data voltage to a gate electrode of the driving transistor; and a storage capacitor which maintains a gate-source voltage of the driving transistor for one frame.

15. The display device according to claim 13, wherein the sensing circuit includes:

a sensing transistor which connects one electrode of the organic light emitting diode and a sensing line in accordance with a sensing signal;

an initializing transistor which applies an initialization voltage to the sensing line in accordance with an initialization signal; and a sampling transistor which applies a voltage applied to the sensing line to the threshold voltage sensing circuit in accordance with a sampling signal.

16. The display device according to claim 2, wherein the dummy area is completely blocked by the finishing material so as not to be exposed outside.

* * * * *